US009639032B2

(12) United States Patent
Tanaka

(10) Patent No.: US 9,639,032 B2
(45) Date of Patent: May 2, 2017

(54) IMAGE FORMING APPARATUS THAT UTILIZES AN ADJUSTABLE ALTERNATELY SWITCHING VOLTAGE

(71) Applicant: Shinya Tanaka, Kanagawa (JP)

(72) Inventor: Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/041,574

(22) Filed: Feb. 11, 2016

(65) Prior Publication Data

US 2016/0246219 A1 Aug. 25, 2016

(30) Foreign Application Priority Data

Feb. 24, 2015 (JP) ..... 2015-034555

(51) Int. Cl.
*G03G 15/16* (2006.01)

(52) U.S. Cl.
CPC ..... *G03G 15/1665* (2013.01); *G03G 15/161* (2013.01); *G03G 15/1675* (2013.01)

(58) Field of Classification Search
CPC ..... G03G 15/321
See application file for complete search history.

(56) References Cited

U.S. PATENT DOCUMENTS

2008/0118259 A1* 5/2008 Yamada ..... G03G 15/161 399/66
2011/0255892 A1 10/2011 Aoki
2012/0045237 A1 2/2012 Aoki et al.
2012/0230715 A1 9/2012 Ogino et al.
2012/0237234 A1 9/2012 Sugimoto et al.
2012/0328314 A1 12/2012 Sugimoto et al.
2013/0004190 A1 1/2013 Sengoku et al.
2013/0089363 A1 4/2013 Mimbu et al.
2013/0121714 A1 5/2013 Tanaka et al.
(Continued)

FOREIGN PATENT DOCUMENTS

EP 2 530 531 A1 12/2012
JP 2006-267486 10/2006
(Continued)

OTHER PUBLICATIONS

U.S. Appl. No. 14/881,293, filed Oct. 13, 2015.
(Continued)

*Primary Examiner* — Clayton E LaBalle
*Assistant Examiner* — Victor Verbitsky
(74) *Attorney, Agent, or Firm* — Oblon, McClelland, Maier & Neustadt, L.L.P.

(57) ABSTRACT

An image forming apparatus includes an image bearer, a transfer device, and a transfer bias power source. The transfer bias power source is configured to output an alternately switching voltage that alternates between a transfer-directional voltage having a polarity to transfer the toner image from the image bearer onto the recording medium and a return-directional voltage having an opposite polarity to the polarity of the transfer-directional voltage. The transfer bias power source is configured to reduce a target value of Vdc as an image area ratio of a toner image to be printed increases, and to increase the target value of Vdc as the image area ratio reduces, where Vdc is an average value of the alternately switching voltage during printing.

20 Claims, 13 Drawing Sheets

(56) References Cited

U.S. PATENT DOCUMENTS

| | | | |
|---|---|---|---|
| 2013/0136468 | A1 | 5/2013 | Shimizu et al. |
| 2013/0136477 | A1 | 5/2013 | Ogiyama et al. |
| 2013/0142531 | A1 | 6/2013 | Sugimoto et al. |
| 2013/0148993 | A1 | 6/2013 | Aoki et al. |
| 2013/0164011 | A1 | 6/2013 | Nakamura et al. |
| 2013/0177329 | A1 | 7/2013 | Tanaka et al. |
| 2013/0195483 | A1 | 8/2013 | Shimizu et al. |
| 2013/0236201 | A1 | 9/2013 | Mizutani et al. |
| 2013/0308968 | A1 | 11/2013 | Tanaka et al. |
| 2014/0010562 | A1 | 1/2014 | Tanaka et al. |
| 2014/0029988 | A1 | 1/2014 | Shimizu et al. |
| 2014/0079418 | A1 | 3/2014 | Tanaka et al. |
| 2014/0248064 | A1 | 9/2014 | Tanaka et al. |
| 2014/0314435 | A1 | 10/2014 | Kato et al. |
| 2014/0328603 | A1 | 11/2014 | Mizutani et al. |
| 2014/0328604 | A1 | 11/2014 | Tanaka et al. |
| 2015/0212453 | A1 | 7/2015 | Tanaka |
| 2015/0346650 | A1 | 12/2015 | Kato et al. |

FOREIGN PATENT DOCUMENTS

| | | |
|---|---|---|
| JP | 2011-227174 | 11/2011 |
| JP | 2012-042835 | 3/2012 |
| JP | 2013-127592 | 6/2013 |
| JP | 2014-178508 | 9/2014 |

OTHER PUBLICATIONS

U.S. Appl. No. 14/881,611, filed Oct. 13, 2015.
Extended European Search Report issued Jun. 21, 2016 in European Application No. 16156229.3.

* cited by examiner

FIG. 6

| | IMAGE AREA RATIO | | | | |
|---|---|---|---|---|---|
| | 5% | 25% | 50% | 100% | |
| COMPARATIVE EXAMPLE 1 | −2.0kV | −2.0kV | −2.0kV | −2.0kV | |
| COMPARATIVE EXAMPLE 2 | −2.0kV | −2.2kV | −2.4kV | −2.6kV | |
| COMPARATIVE EXAMPLE 3 | −2.0kV | −2.2kV | −2.4kV | −2.6kV | ← Vdc1 |
| EXAMPLE 1 | −2.0kV (V1) | −1.9kV (V1) | −1.8kV (V1) | −1.7kV (V1) | ← Vdc1 |
| EXAMPLE 2 | −2.0kV (V1) | −1.8kV (V1) | −1.6kV (V1) | −1.4kV (V1) | ← Vdc1 |
| EXAMPLE 3 | −40 μA (A1) | −39 μA (A1) | −38 μA (A1) | −37 μA (A1) | ← Vdc1 |
| EXAMPLE 4 | −40 μA (A1) | −38 μA (A1) | −38 μA (A1) | −34 μA (A1) | ← Vdc1 |

FIG. 7

| | TRANSFERABILITY OF RAISED PORTION | | | |
|---|---|---|---|---|
| | 5% | 25% | 50% | 100% |
| COMPARATIVE EXAMPLE 1 | EXCELLENT | EXCELLENT | GOOD | POOR |
| COMPARATIVE EXAMPLE 2 | EXCELLENT | EXCELLENT | EXCELLENT | EXCELLENT |
| COMPARATIVE EXAMPLE 3 | EXCELLENT | GOOD | FAIR | POOR |
| EXAMPLE 1 | EXCELLENT | EXCELLENT | GOOD | GOOD |
| EXAMPLE 2 | EXCELLENT | EXCELLENT | EXCELLENT | EXCELLENT |
| EXAMPLE 3 | EXCELLENT | EXCELLENT | GOOD | GOOD |
| EXAMPLE 4 | EXCELLENT | EXCELLENT | EXCELLENT | EXCELLENT |

FIG. 8

| | TRANSFERABILITY OF RECESSED PORTION | | | |
|---|---|---|---|---|
| | 5% | 25% | 50% | 100% |
| COMPARATIVE EXAMPLE 1 | POOR | POOR | POOR | POOR |
| COMPARATIVE EXAMPLE 2 | POOR | POOR | POOR | POOR |
| COMPARATIVE EXAMPLE 3 | GOOD | GOOD | GOOD | GOOD |
| EXAMPLE 1 | GOOD | GOOD | GOOD | GOOD |
| EXAMPLE 2 | GOOD | GOOD | GOOD | GOOD |
| EXAMPLE 3 | GOOD | GOOD | GOOD | GOOD |
| EXAMPLE 4 | GOOD | GOOD | GOOD | GOOD |

FIG. 9

| | EDGE RATIO | | |
|---|---|---|---|
| | 10 | 50 | 100 |
| COMPARATIVE EXAMPLE 4 | −2.0kV | −2.0kV | −2.0kV |
| EXAMPLE 5 | −2.0kV | −2.2kV | −2.4kV |

← Vdc1

FIG. 10

| | EDGE RATIO | | |
|---|---|---|---|
| | 10 | 50 | 100 |
| COMPARATIVE EXAMPLE 4 | EXCELLENT | FAIR | POOR |
| EXAMPLE 5 | EXCELLENT | EXCELLENT | EXCELLENT |

FIG. 11A
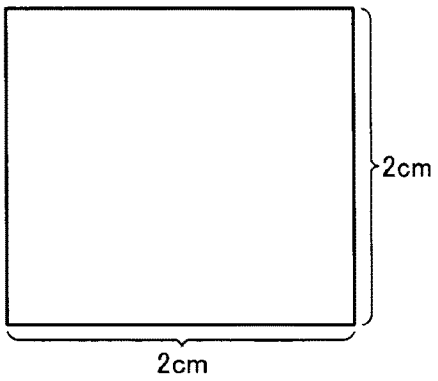
FIG. 11B
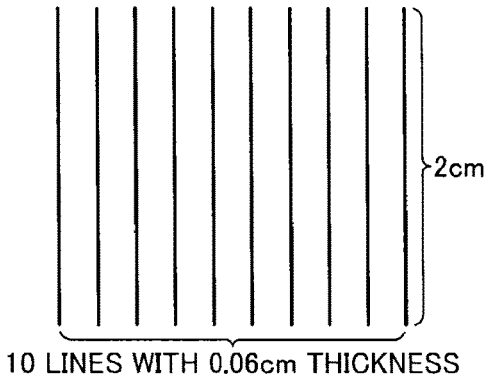
FIG. 12
| | SOLID IMAGE | LINE-AND-CHARACTER IMAGE |
|---|---|---|
| COMPARATIVE EXAMPLE 5 | -2.0kV | -2.0kV |
| EXAMPLE 6 | -1.6kV | -2.0kV |
← Vdc1
FIG. 13
| | SOLID IMAGE | LINE-AND-CHARACTER IMAGE |
|---|---|---|
| COMPARATIVE EXAMPLE 5 | POOR | EXCELLENT |
| EXAMPLE 6 | EXCELLENT | EXCELLENT |

IMAGE FORMING APPARATUS THAT UTILIZES AN ADJUSTABLE ALTERNATELY SWITCHING VOLTAGE

CROSS-REFERENCE TO RELATED APPLICATION

This patent application is based on and claims priority pursuant to 35 U.S.C. §119(a) to Japanese Patent Application No. 2015-034555, filed on Feb. 24, 2015, in the Japan Patent Office, the entire disclosure of which is hereby incorporated by reference herein.

BACKGROUND

Technical Field

Aspects of the present disclosure relate to an image forming apparatus.

Related Art

An electrophotographic image forming apparatus conveys a transfer material to a transfer nip formed at a position opposing an image bearer and applies a transfer bias to transfer a toner image from the image bearer onto a recording medium in the transfer nip. In such a configuration, when using a recording medium having a coarse surface or an embossed surface such as Japanese paper (also known as Washi), a pattern of light and dark (unevenness of image density) according to the surface condition of the recording medium appears in an output image. More specifically, toner does not transfer well to such embossed surfaces, in particular, recessed portions of the surface. This inadequate transfer of the toner appears as a pattern of light and dark in the resulting output image.

SUMMARY

In an aspect of this disclosure, there is provided an image forming apparatus, including: an image bearer having a surface to bear a toner image; a transfer device configured to contact the surface of the image bearer to form a transfer nip, and a transfer bias power source configured to output a transfer bias to transfer the toner image from the image bearer onto a recording medium interposed between the transfer device and the image bearer in the transfer nip. The transfer bias power source is configured to output an alternately switching voltage that alternates between a transfer-directional voltage having a polarity to transfer the toner image from the image bearer onto the recording medium and a return-directional voltage having an opposite polarity to the polarity of the transfer-directional voltage. The transfer bias power source is configured to reduce a target value of Vdc as an image area ratio of a toner image to be printed increases, and to increase the target value of Vdc as the image area ratio reduces, where Vdc is an average value of the alternately switching voltage during printing.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 6 is a table of the relations between image area ratios and the levels of a direct current (DC) voltage of a secondary transfer bias according to Comparative Examples and Examples;

FIG. 7 is a table of evaluation of transferability in a raised portion of a recording medium with the image area ratios and the levels of the DC voltage of the secondary transfer bias varied, according to Comparative Examples and Examples;

FIG. 8 is a table of evaluation of transferability in a recessed portion of the recording medium with the image area ratios and the levels of the DC voltage of the secondary transfer bias varied according to Comparative Examples and Examples;

FIG. 9 is a table of the relations between edge ratios of images and the levels of the DC voltage of the secondary transfer bias according to Comparative Example and Example;

FIG. 10 is a table of evaluation of transferability in the recording medium with the edge ratios and the levels of the DC voltage of the secondary transfer bias varied according to Comparative Example and Example;

FIG. 11A is an illustration for explaining an edge ratio in one image area;

FIG. 11B is another illustration for explaining an edge ratio in one image area;

FIG. 12 is a table of the relations between types of images to be printed, such as a solid image and a line-and-character image, and variable levels of the DC voltage of the secondary transfer bias during printing according to Comparative Example and Example;

FIG. 13 is a table of evaluation of transferability in the recording medium with the types of images (the solid image and the line-and-character image) and the levels of the DC voltage of the secondary transfer bias varied during printing according to Comparative Example and Example;

Figure 1:
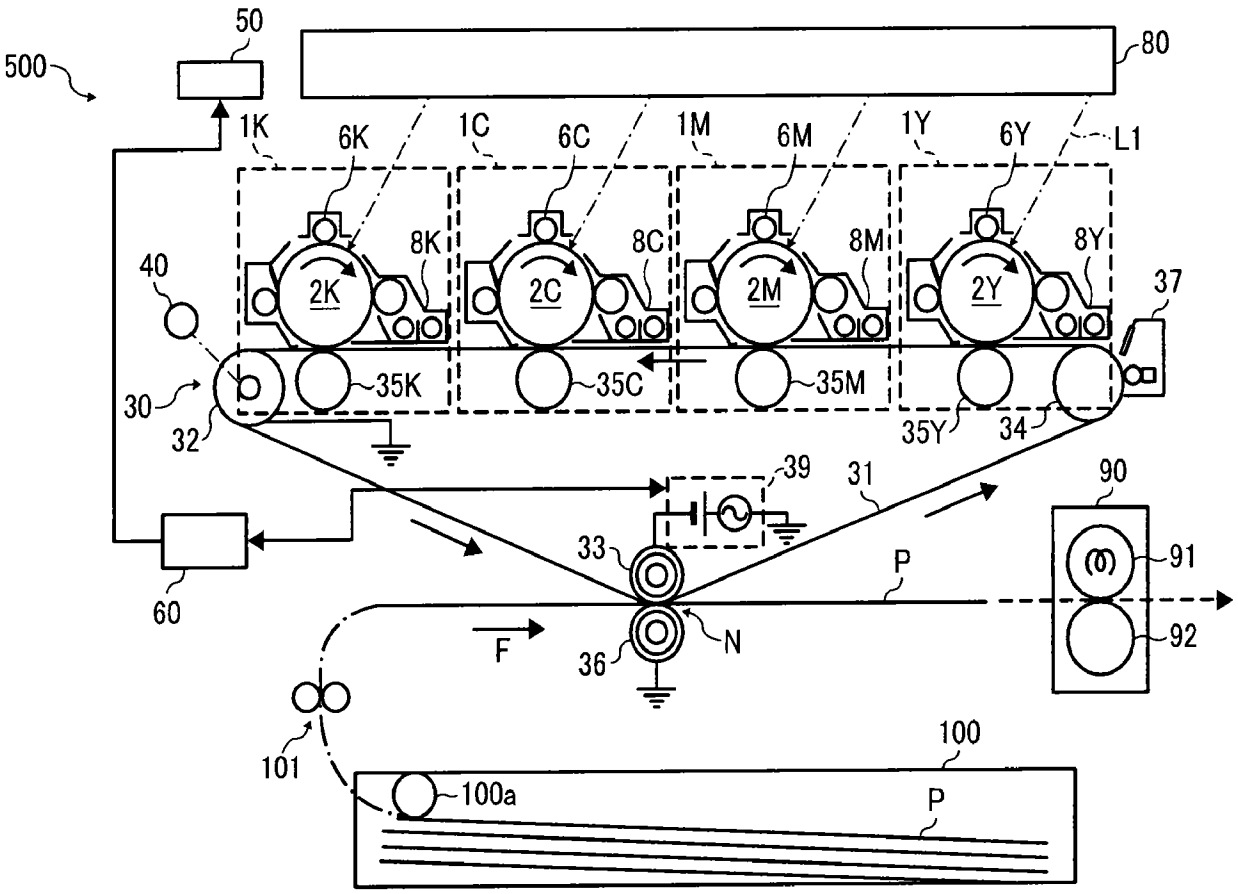
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable. Referring now to the drawings, embodiments of the present disclosure are described below. In the drawings for explaining the following embodiments, the same reference codes are allocated to elements (members or components) having the same function or shape and redundant descriptions thereof are omitted below.

With reference to FIG. 1, a description is provided of an electrophotographic color printer as an example of an image forming apparatus according to a first embodiment of the present disclosure. FIG. 1 is a schematic view of a printer (hereinafter, referred to as the image forming apparatus) as an example of an image forming apparatus of the present disclosure. As illustrated in FIG. 1, the image forming apparatus includes four toner image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus 500 includes a transfer unit 30 serving as a transfer device, an optical writing unit 80, a fixing device 90, a paper cassette 100, and a pair of registration rollers 101.

Figure 2:
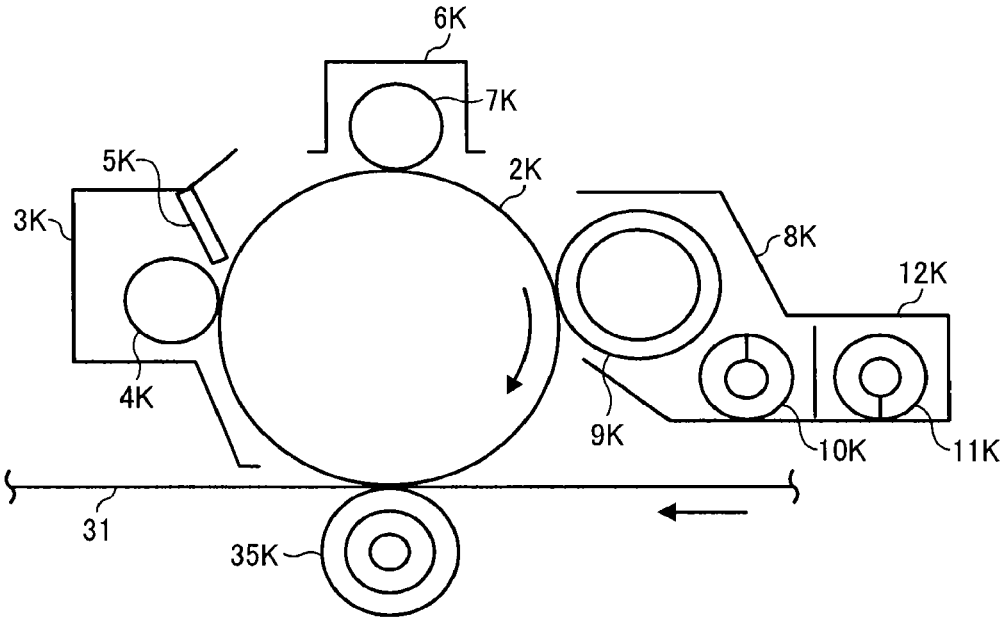
FIG. 2 is an enlarged view of a toner image forming unit for black color as a representative example of toner image forming units employed in the image forming apparatus of FIG. 1.

The toner image forming units 1Y, 1M, 1C, and 1K all have the same configuration as all the others, except for different colors of toner employed. Thus, a description is provided of the toner image forming unit 1K for forming a toner image of black as a representative example of the toner image forming units 1Y, 1M, 1C, and 1K. Thus, a description is provided of the image forming unit 1K for forming a toner image of black as a representative example of the image forming units. As illustrated in FIG. 2, the image forming unit 1K includes a drum-shaped photoconductor 2K as an image bearer, a photoconductor cleaner 3K, a charging device 6K (6C, 6M, and 6Y for the toner image forming units 1C, 1M, and 1Y, respective), and a developing device 8K (8C, 8M, and 8Y for the toner image forming units 1C, 1M, and 1Y, respective). These devices are held in a common casing so that they are detachably installable and replaceable all together relative to the main body. The image forming unit 1K is replaceable independently.

The photoconductor 2K includes a drum-shaped base on which an organic photosensitive layer is disposed. The photoconductor 2K is rotated in a clockwise direction by a driving device. The charging device 6K includes a charging roller 7K to which a charging bias is applied. The charging roller 7K contacts or is disposed in proximity to the photoconductor 2K to generate electrical discharge between the charging roller 7K and the photoconductor 2K, thereby charging uniformly the surface of the photoconductor 2K. According to the present embodiment, the photoconductor 2K is uniformly charged with a negative polarity, which is the same polarity as the polarity of normally-charged toner. More specifically, the photoconductor 2K is uniformly charged with a voltage of approximately −650 V. As a charging bias, an alternating current voltage (alternating component) superimposed on a direct current (direct component) voltage is employed. Instead of using a charging device, such as a charging roller, that contacts or disposed close to the photoconductor 2K, a charging method that employs a corona charger, which does not contact the photoconductor 2K, may be employed.

The surface of the photoconductor 2K uniformly charged by the charging device 6K is scanned by laser light projected from the optical writing unit 80, thereby forming an electrostatic latent image for black on the surface of the photoconductor 2K. The electrostatic latent image for black has a potential of approximately −100 V. The electrostatic latent image for black on the photoconductor 2K is developed with black toner by the developing device 8K. Accordingly, a visible image, also known as a toner image of black, is formed on the photoconductor 2K. As will be described later in detail, the toner image is transferred primarily onto an intermediate transfer belt 31 as an image bearer formed into a belt shape or an intermediate transferor in a process known as a primary transfer process.

The photoconductor cleaner 3K removes residual toner remaining on the surface of the photoconductor 2K after a primary transfer process, that is, after the photoconductor 2K passes through a primary transfer nip between the intermediate transfer belt 31 and the photoconductor 2K. In the photoconductor cleaner 3K, the brush roller 4K rotates and brushes off the residual toner from the surface of the photoconductor 2K while the cleaning blade 5K scraping off the residual toner from the surface of the photoconductor 2K. The static eliminator removes residual charge remaining on the photoconductor 2K, initializing the surface of the photoconductor 2K after the surface thereof is cleaned by the photoconductor cleaner 3K, in preparation for the subsequent imaging cycle.

The developing device 8K includes a developing roller 9K as a developer bearer, a first screw 10K, and a second screw 11K as a developer stirring device. The developing device 8K includes a developing roller 9K as a developer bearer, a first screw 10K, and a second screw 11K as a developer stirring device.

The developing roller 9K is opposed to the photoconductor 2K through an opening formed in the developing casing 12K, to convey toner for black supplied from the first screw 10K to a developing area facing the photoconductor 2K. The developing roller 9K is supplied with a developing bias having the same polarity as that of the toner. The developing bias is greater than the bias of the electrostatic latent image on the photoconductor 2K, but less than the charging potential of the uniformly charged photoconductor 2K. Due to the developing potential and the non-developing potential, the toner on the developing roller 9K moves selectively to the electrostatic latent image formed on the photoconductor 2K, thereby forming a visible image, known as a black toner image.

Similar to the toner image forming unit 1K, toner images of yellow, magenta, and cyan are formed on the photoconductors 2Y, 2M, and 2C of the toner image forming units 1Y, 1M, and 1C, respectively.

The optical writing unit 80 as a latent writing device is disposed above the image forming units 1Y, 1M, 1C, and 1K. Based on image information transmitted from an external terminal, such as a personal computer (PC), the optical writing unit 80 illuminates the photoconductors 2Y, 2M, 2C, and 2K with the laser light projected from a light source, such as a laser diode. Accordingly, the electrostatic latent images of yellow, magenta, cyan, and black are formed on the photoconductors 2Y, 2M, 2C, and 2K, respectively. Alternatively, the optical writing unit 80 may employ, as a latent image writer, an LED array including a plurality of LEDs that project light.

The transfer unit 30 as a latent writing device is disposed above the image forming units 1Y, 1M, 1C, and 1K. The transfer unit 30 also includes a drive roller 32, a secondary-transfer back surface roller 33, a cleaning auxiliary roller 34, four primary transfer rollers 35Y, 35M, 35C, and 35K (which may be referred to collectively as primary transfer rollers 35), a nip forming roller 36 as a transfer device, and a belt cleaning device 37.

The intermediate transfer belt 31 formed into a loop is stretched taut around the drive roller 32, the secondary-transfer back surface roller 33, the cleaning auxiliary roller 34, and the four primary transfer rollers 35Y, 35M, 35C, and 35K, those are disposed inside the loop. The drive roller 32 is rotated in the counterclockwise direction by a drive device, and rotation of the drive roller 32 enables the intermediate transfer belt 31 to rotate in the same direction.

The four transfer rollers 35Y, 35M, 35C, and 35K are configured to press against the respective photoconductors 2Y, 2M, 2C, and 2K via the intermediate transfer belt 31 endlessly moving. Accordingly, primary transfer nips are formed between a front surface of the intermediate transfer belt 31 and the photoconductors 2Y, 2M, 2C, and 2K that contact the intermediate transfer belt 31. A primary transfer power source applies a primary transfer bias to the primary transfer rollers 35Y, 35M, 35C, and 35K. Accordingly, a transfer electric field is formed between the primary transfer rollers 35Y, 35M, 35C, and 35K, and the toner images of yellow, magenta, cyan, and black formed on the photoconductors 2Y, 2M, 2C, and 2K, respectively. The yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electric field and the nip pressure. Then, the intermediate transfer belt 31 having the yellow toner image primarily transferred thereon sequentially passes through the primary transfer nips of yellow, magenta, cyan, and black, accordingly. Subsequently, a magenta toner image, a cyan toner image, and a black toner image on the photoconductors 2M 2C, and 2K are sequentially superimposed on the yellow toner image which has been transferred on the intermediate transfer belt 31, one atop the other in the primary transfer process. Accordingly, the composite toner image, in which the toner images of yellow, magenta, cyan, and black are superimposed one atop the other, is formed on the surface of the intermediate transfer belt 31. The composite toner image is formed in a case of multiple color printing. In a case of a single color printing, a toner image of one color is transferred from one photoconductor onto the intermediate transfer belt 31.

The primary transfer rollers 35Y, 35M, 35C, and 35K described above are supplied with a primary transfer bias under constant current control. According to the present embodiment, roller-type primary transfer devices, that is, the primary transfer rollers 35Y, 35M, 35C, and 35K, are employed as primary transfer devices. Alternatively, a transfer charger and a brush-type transfer device may be employed as the primary transfer device.

The nip forming roller 36 is disposed outside the loop formed by the intermediate transfer belt 31, opposed to the secondary-transfer back surface roller 33 which is disposed inside the loop. The intermediate transfer belt 31 is interposed between the secondary-transfer back surface roller 33 and the nip forming roller 36. Accordingly, a secondary transfer nip N is formed between the peripheral surface or the image bearing surface of the intermediate transfer belt 31 and the nip forming roller 36 contacting the surface of the intermediate transfer belt 31. In the example illustrated in FIG. 1. the nip forming roller 36 is grounded. By contrast, a secondary transfer bias is applied to the secondary-transfer back surface roller 33 by a secondary transfer bias power source 39. With this configuration, a secondary transfer electrical field is formed between the secondary-transfer back surface roller 33 and the nip forming roller 36 so that the toner having a negative polarity is transferred electrostatically from the secondary-transfer back surface roller side to the nip forming roller side.

As illustrated in FIG. 1, the paper cassette 100 storing a sheaf of recording media sheets P is disposed below the transfer unit 30. The paper cassette 100 includes a feed roller 100*a* to contact the top sheet of the sheaf of recording media P. The feed roller 100*a* rotates at a predetermined speed to pick up the top sheet of the recording media P and send it to a medium passage. Substantially at the end of the medium passage is disposed the pair of registration rollers 101. The pair of registration rollers 101 is driven to rotate again to feed the recording medium P to the secondary transfer nip N in appropriate timing such that the recording medium P is aligned with the composite toner image or a single-color toner image formed on the intermediate transfer belt 31 contacting the recording medium P in the secondary transfer nip N. In the secondary transfer nip, the recording medium P tightly contacts the composite toner image or the single-color toner image on the intermediate transfer belt 31, and the composite toner image or the single-color toner image is secondarily transferred onto the recording medium P by the secondary transfer electric field and the nip pressure applied thereto, thereby combining with a white color on the recording medium P to form a full-color toner image (composite toner image) or a single-color toner image on the surface of the recording medium P.

The fixing device 90 is disposed downstream from the secondary transfer nip N in a direction (indicated by arrow F) of conveyance of the recording medium P. The fixing device 90 includes a fixing roller 91 and a pressing roller 92. The fixing roller 91 includes a heat source inside the fixing roller 91. While rotating, the pressing roller 92 pressingly contacts the fixing roller 91, thereby forming a heated area called a fixing nip therebetween. Under heat and pressure, the toner adhered to the toner image is softened and fixed to the recording medium P having the full-color toner image or the single-color toner image transferred thereon in the fixing nip. After the toner image is affixed to the recording medium P, the recording medium P exits the fixing device 90.

Subsequently, the recording medium P goes outside the image forming apparatus 500 through a post-fixing medium path.

After the intermediate transfer belt 31 passes through the secondary transfer nip N, the toner residue not having been transferred onto the recording medium P remains on the intermediate transfer belt 31. The residual toner is removed from the intermediate transfer belt 31 by the belt cleaning device 37 which contacts the front surface of the intermediate transfer belt 31.

In the present embodiment, the power source 39 outputs the secondary transfer bias to transfer a toner image onto the recording medium P interposed in the secondary transfer nip N. The power source 39 includes a direct current (DC) power source to output only a direct current voltage (direct current component) and an alternating current (AC) power source to output a superimposed bias, in which an alternating current voltage (alternating current component) is superimposed on the direct current voltage.

An aspect of supplying a secondary transfer bias is not limited to the aspect illustrated in FIG. 1. Alternatively, the power source 39 may apply the superimposed bias to the nip forming roller 36 with the secondary-transfer back surface roller 33 grounded. In this case, the polarity of the DC voltage is changed. More specifically, as illustrated in FIG. 1, when the superimposed bias is applied to the secondary-transfer back surface roller 33 while the toner has a negative polarity and the nip forming roller 36 is grounded, the DC voltage having the same negative polarity as the toner is used so that a time-averaged potential of the superimposed bias has the same negative polarity as the toner.

By contrast, in a case in which the secondary-transfer back surface roller 33 is grounded and the superimposed bias is applied to the nip forming roller 36, the DC voltage having the positive polarity opposite to that of the toner is used so that the time-averaged potential of the superimposed bias has the positive polarity which is opposite to that of the toner.

An another aspect of supplying a secondary transfer bias (the superimposed bias) is not limited to aspects in which the superimposed bias is applied to either one of the secondary-transfer back surface roller 33 and the nip forming roller 36. For example, in some embodiments, one of two separately-disposed power sources applies the DC voltage to either one of the secondary-transfer back surface roller 33 and the nip forming roller 36, and the other power source applies the superimposed voltage to the other roller.

As still another aspect of supplying a secondary transfer bias, either one of the secondary-transfer back surface roller 33 and the nip forming roller 36 is supplied with the secondary transfer bias alternated between the bias including the superimposed voltage, in which the DC voltage is superimposed on the AC voltage, and the bias including the DC voltage.

As still another aspect of supplying a secondary transfer bias, either one of the secondary-transfer back surface roller 33 and the nip forming roller 36 is supplied with the secondary transfer bias alternated between the bias including the superimposed voltage, in which the DC voltage is superimposed on the AC voltage, and the bias including only the DC voltage. Alternatively, in some embodiments, one of separately-disposed power sources supplies the bias including the superimposed voltage, in which the DC voltage is superimposed on the AC voltage, to either one of the secondary-transfer back surface roller 33 and the nip forming roller 36. The other power source supplies the bias including only the DC voltage to the other roller. The two power sources are switched as appropriate.

Among various aspects of application of the secondary transfer bias to the secondary transfer nip N, in this case, the power source 39 of FIG. 1 supplies the voltage including the superimposed voltage, in which the DC voltage is superimposed on the AC voltage. Alternatively, separate power sources respectively supply the voltage including the superimposed voltage, in which the DC voltage is superimposed on the AC voltage, and the voltage including only the DC voltage. Alternatively, one power source outputs the voltage that alternates between the voltage including the superimposed voltage, in which the DC voltage is superimposed on the AC voltage and the voltage including only the DC voltage.

The power source 39 outputs the secondary transfer bias under constant voltage control or constant current control. The constant voltage control refers to controlling the power source 39 to output a constant voltage. The constant current control refers to controlling the power source 39 to output a constant current. For example, the controller 60 controls the power source 39 to output a constant voltage and a constant current.

The power source 39 switches between a direct current transfer mode (a first mode) to output a voltage including only the DC voltage and an alternating current transfer mode (a second mode) to output a voltage including the superimposed voltage (alternately switching voltage), in which the AC voltage is superimposed on the DC voltage. In the image forming apparatus of the present disclosure, switching the output of the AC voltage of the power source 39 ON/OFF allows the power source 39 to switch between the first mode and the second mode. The controller 60 controls such an ON/OFF switching of the output of the AC voltage of the power source 39.

When using a normal sheet of paper, such as the one having a relatively smooth surface, instead of using paper having a rough surface, a pattern of light and dark according to the surface conditions of the recording medium P is less likely to appear on the recording medium P. In this case, the transfer bias including only the DC voltage is supplied. In this case as well, the secondary transfer bias including only the DC voltage is output from the power source 39 to the secondary-transfer back surface roller 33. In contrast, when using a recording medium having an uneven surface such as pulp paper and embossed paper, the power source 39 outputs the superimposed voltage, in which the AC voltage is superimposed on the DC voltage, as the secondary transfer bias in the second mode. That is, in the image forming apparatus of the present embodiment, the power source 39 alternates the secondary transfer bias between the first mode and the second mode, according to the type of the recording medium P to be used (the size of the unevenness on the surface of the recording medium P). To alternate the first mode and the second mode, for example, an optical detector is used to detect the reflectivity of the recording medium P employed, and based on the detection result (value) of the optical detector, the controller 60 determines the type of the recording medium P. In response to the determination result, the controller 60 further controls the power source 39 to output the voltage in either one of the first mode and the second mode.

Alternatively, in some embodiments, the image forming apparatus 500 may include a selecting device that allows an operator to select the type of the recording medium P. Operating the selecting device outputs a signal, in response to which, the controller 60 determines the type of the recording medium P. In response to the determination result of the controller 60, the controller 60 further controls the power source 39 to output the secondary transfer bias in either of the first mode and the second mode.

In the image forming apparatus that applies the secondary transfer bias to the secondary-transfer back surface roller 33 and has the nip forming roller 36 grounded, when the polarity of the secondary transfer bias is negative so is the polarity of the toner, the toner having the negative polarity is electrostatically pushed out of the secondary-transfer back surface roller 33 to the nip forming roller 36 in the secondary transfer nip N. Accordingly, the toner is transferred from the intermediate transfer belt 31 onto the recording medium P. In contrast, when the polarity of the secondary transfer bias is opposite to that of the toner, that is, the polarity of the secondary transfer voltage is positive, the toner having the negative polarity is electrostatically attracted from the nip forming roller 36 to the secondary-transfer back surface roller 33. Consequently, the toner transferred to the recording medium P is attracted again to the intermediate transfer belt 31.

In the image forming apparatus of the present disclosure, the secondary transfer bias includes a direct current component of the same value as the time-averaged value (Vave) of the voltage, that is, a time-averaged voltage value (time-averaged value Vave) of the direct current component. The time-averaged value of the voltage (Vave) refers to a value obtained by dividing an integral value of a voltage waveform over one cycle by the length of the one cycle. In addition, in the present embodiment, "Vdc" (in FIG. 5) refers to an average value of the secondary transfer voltage applied during printing, which is synonymous with "Vave".

When using a recording medium P having an uneven surface, such as Japanese paper (also known as Washi), a pattern of light and dark (unevenness of image density) according to the surface condition of the recording medium easily appears in an output image. In view of the above, according to U.S. Application No. 2012045237, it has been proposed that a superimposed voltage, in which a DC voltage (a direct current component) is superimposed on an AC voltage (an alternating current component), is applied as a transfer bias (or a secondary transfer bias). In addition, an image area ratio (a toner adhesion amount) is used to adjust the level of the transfer bias, such that as the image area ratio increases, either or both of the AC voltage and the DC voltage is/are increased. Such adjustment suppresses the occurrence of patterns of light and dark in output images. The contents of U.S. Application No. 2012045237 is incorporated herein by reference in its entirety.

In this regard, the inventor of the present application has found that a successful transfer fails to be obtained in a raised portion (a smooth and flat portion) with a small amount of image area, i.e., a portion including lines or dots on the surface of a recording medium, through the experiments, in which as the image area ratio of a toner image increases, either or both of the AC voltage and the DC voltage of the transfer bias are increased. The inventor has also found that the image forming apparatus fails to successfully transfer toner onto raised portions (flat surface portions) having small amounts of image areas, i.e., portions where lines or dots are included, when applying a direct current (DC) voltage as a secondary transfer bias in such a manner that the amount of the DC bias decreases as the image area ratio decreases.

In view of the above, the image forming apparatus 500 of the present embodiment is configured such that when changing Vdc according to a variable image area ratio of a toner image during printing, as the image area ratio increases, Vdc is reduced, and as the image area ratio reduces, the target value Vdc 1 is increased. In this case, "Vdc" refers to an average value of the secondary transfer bias. Further, in the image forming apparatus 500 of the present embodiment, the controller 60 is configured to control the power source 39 to change the level of the DC voltage according to the image area ratio, to output a secondary transfer bias including a superimposed bias with a target value Vdc 1.

Aspects of control of the controller 60 include the following:

1) The controller 60 changes Vdc according to an edge ratio of a toner image during printing, in such a manner that the greater the edge ratio, the greater the target value Vdc1.

2) The controller 60 changes Vdc according to a ratio of a line-and-character image to a solid image in a toner image to be printed, in such a manner that the greater the ratio of the line-and-character image, the greater the target value Vdc 1 of Vdc.

A description is provided of the above-described aspects of control of the controller 60.

Figure 3:
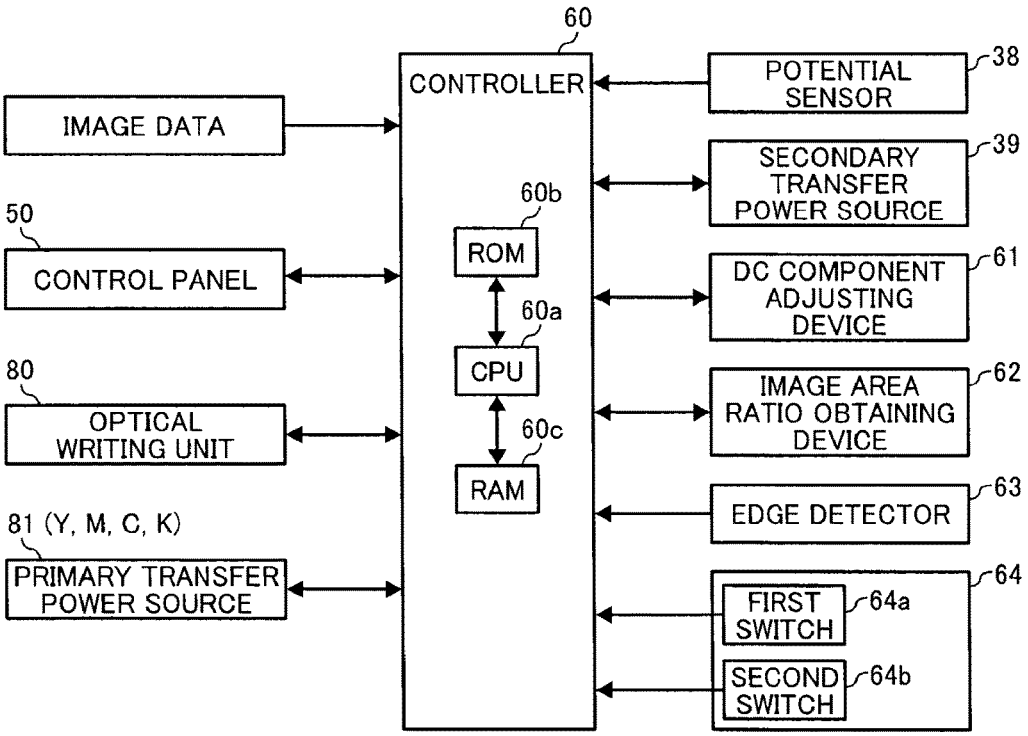
FIG. 3 is a block diagram of one example of a control system of the image forming apparatus of FIG. 1.

FIG. 3 is a block diagram of a portion of a control system of the image forming apparatus. In FIG. 3, a controller 60 includes a central processing unit (CPU) 60*a* serving as a computing device, a random access memory (RAM) 60*c* serving as a nonvolatile memory, a read only memory (ROM) 60*b* serving as a temporary storage device, and a flash memory 60*d*. The controller 60 typically includes various constitutional components and sensors communicably connected thereto via signal lines to control the entirety of the image forming apparatus. FIG. 3 illustrates representative components and sensors of the image forming apparatus 500. It should be noted that FIG. 3 illustrates the components and sensors employed in the present embodiments, and a description is provided of the components and sensors as devices that serve as the controller 60.

The image forming apparatus of the present embodiment includes a potential sensor 38. The potential sensor detects the surface potential of the toner image primarily transferred onto the intermediate transfer belt 31 when the toner image comes to the position opposite to the potential detector 38. The potential sensor 38 is connected to the controller 60 via a signal line, to output a detected value of the surface potential of the toner image to the controller 60.

A control panel 50 include a touch panel having a screen and a plurality of keys, allowing the screen of the touch panel to display an image. The control panel 50 further receives an input of an operator via the touch panel and keys to send input data to the controller.

Primary transfer power sources 81Y, 81M, 81C, and 81K respectively apply a primary transfer bias to primary transfer rollers 35Y, 35M, 35C, and 35K.

A secondary transfer power source 39 outputs a secondary transfer bias applied to a secondary transfer nip N. In the present embodiment, the secondary transfer power source 39 applies a secondary transfer bias to a secondary-transfer back surface roller 33. The controller 60 controls the output from the power source 39.

The image forming apparatus of the present embodiment further includes a DC component adjusting device 61, an image area ratio obtaining device 62, an edge detector 63, and an image type selecting device 64. The DC component adjusting device 61 adjusts the level of the DC voltage of the secondary transfer bias output from the power source 39. The DC component adjusting device 61 includes a direct current to direct current (DC-DC) converter, for example.

The image area ratio obtaining device 62 obtains an image area ratio of a toner image to be printed, based on the toner adhesion amount of the toner image. In particular, there is a correlation between an image area ratio of a composite toner image in a nip and a toner adhesion amount per unit area in the nip. Thus, the toner adhesion amount per unit area in the nip is obtained by calculating the image area ratio of the composite toner image in the nip. The configuration and method of the image area ratio obtaining device 62 is described in U.S. Application No. 2012045237.

The edge detector 63 detects a contour portion of a toner image. For example, the edge detector 63 is constituted by a photo sensor to photograph a toner image and the logic that conducts an image processing on an edge portion based on the photographed toner image to extract the edge portion.

The image type selecting device 64 includes a first switch 64*a* and a second switch 64*b*, to select either of a solid image and a line-and-character image regarding a toner image. The first switch 64*a* is dedicated to selection of the solid image, and the second switch 64*b* is dedicated to selection of the line-and-character image. In response to an operation of either of the first switch 64*a* and the second switch 64*b*, an "ON" signal is send to the controller 60.

In the present embodiment, the controller 60 controls an operation of the entirety of the image forming apparatus 500 to control the output of the power source 39. Alternatively, in some embodiments, another controller 60 controls the output of the power source 39, independently of the controller that controls the entirety of the image forming apparatus.

In the present embodiment, the time-averaged value Vave of the voltage in the alternating current component of the secondary transfer bias is more toward the transfer side than the midpoint voltage value Voff (the center value of the maximum and minimum of the voltage) of the maximum value and the minimum value of the alternating component. To achieve such a relation of the values of Vave and Voff, an area of a waveform on the return-direction side is smaller than an area of a waveform on the transfer-direction side across the midpoint voltage value Voff of the alternating component. When the maximum value of the voltage output from the power source 39 applied is a return-directional peak value Vr and the minimum value of the voltage from the power source 39 is a transfer-directional peak value Vt, the difference between the maximum Vr and the minimum Vt of the voltage applied for transfer is a peak-to-peak voltage value Vpp.

Figure 4:
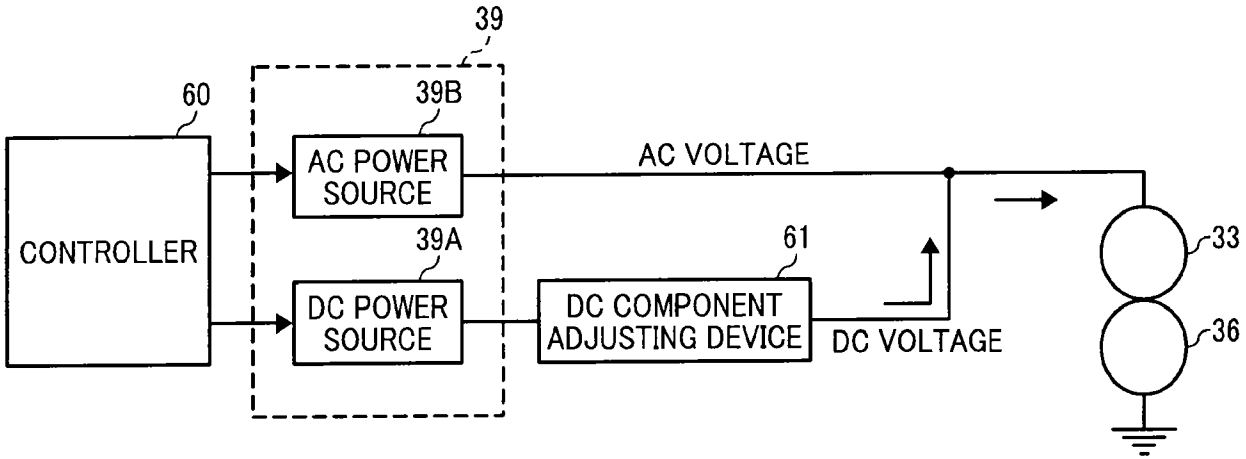
FIG. 4 is a block diagram of one example of control of a secondary transfer bias.

FIG. 4 is a block diagram of one example of adjustment of output of a direct current component of a secondary transfer bias. As described above, the image forming apparatus of the present embodiment includes the frequency adjusting device 61 to adjust the level of the DC voltage included in the secondary transfer bias output from the power source 39. The power source 39 includes a direct current power source (hereinafter, referred to as a DC power source) 39A and an alternating current power source (hereinafter, referred to as an AC power source) 39B. Each of the DC power source 39A, the AC power source 39B, and the DC component adjusting device 61 is connected to the controller 60 via a signal line, so that the controller 60 controls the DC power source 39A, the AC power source 39B, and the DC component adjusting device 61. The AC power source 39B is connected with the secondary-transfer back surface roller 33 via the DC component adjusting device 61, such as an inverter.

The controller 60 controls the power source 39 to output the secondary transfer bias having been alternated between the DC voltage and the superimposed voltage (the AC voltage is superimposed on the DC voltage). The controller 60 further controls the DC component adjusting device 61 to adjust the level of the DC voltage of the secondary transfer bias including the superimposed voltage or the level of the DC voltage of the secondary transfer bias including only the DC voltage. The secondary transfer bias, which is applied from the power source 39 to the secondary transfer back surface roller 33, includes two types: a direct current and a superimposed bias in which an alternating current, that is, an alternating current component is superimposed on a direct current, that is, a direct current component.

Figure 5:
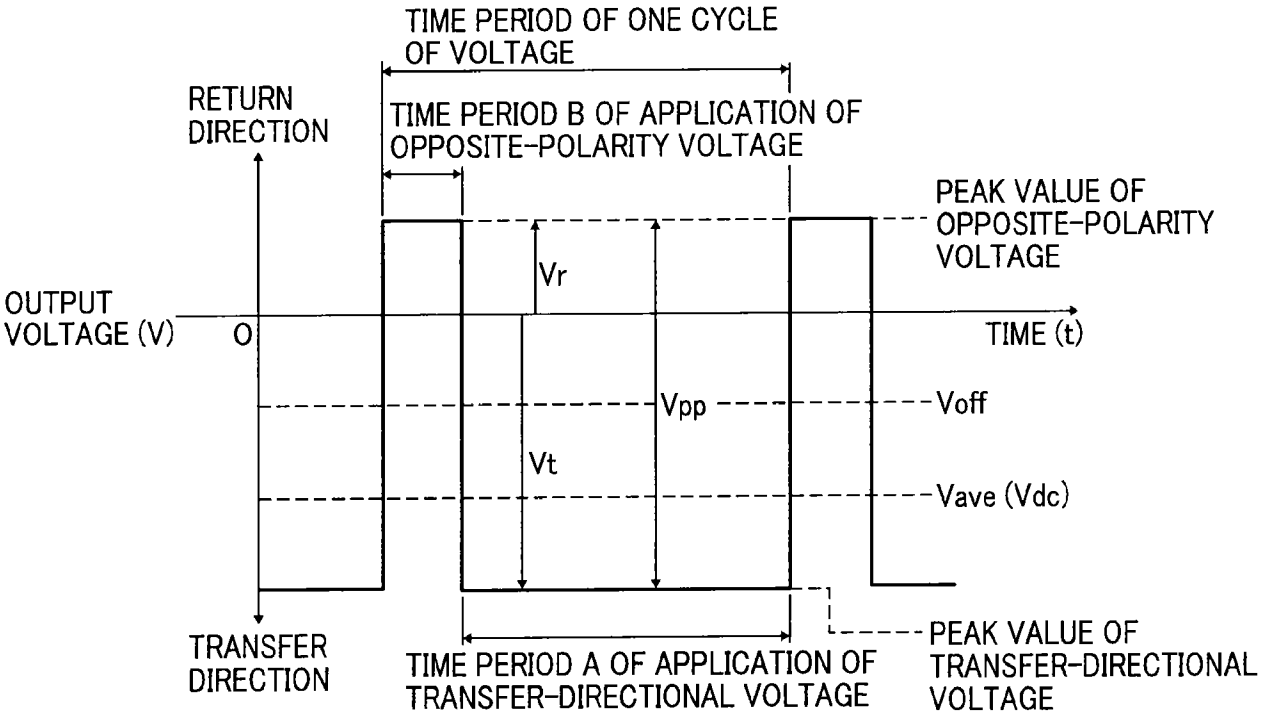
FIG. 5 is a chart of one example of a voltage waveform of a secondary bias output from a secondary transfer power source under control of a controller.

Next, a description is provided of a waveform pattern of output of the power source 39. FIG. 5 is a view of one example of a waveform pattern of the secondary transfer bias. The waveform pattern illustrated in FIG. 5 is a rectangular wave, in which a transfer-directional voltage and a return-directional voltage are alternated. The transfer-directional voltage transfers a toner image from a side of the intermediate transfer belt 31 (a side of the image bearer) to a side of the recording medium P (a side of the recording medium). The return-directional voltage has a polarity opposite to that of the transfer-directional voltage to transfer the toner image in a direction opposite to the transfer direction. When a time period of application of the transfer-directional voltage is A and a time period of application of the return-directional voltage is B, the controller 60 controls the power source 39 to output the secondary transfer bias such that A is longer (greater) than B (A>B). The ratio of A to B is a duty cycle.

Further, in the image forming apparatus 500 of the present embodiment, when the average value of the secondary transfer bias during printing is Vdc, as an image area ratio increases, Vdc is reduced, and as the image area ratio reduces, the target value Vdc 1 is increased while changing Vdc according to a variable image area ratio of a toner image during printing.

Experiment 1

Next, a description is provided of the experiment using a waveform pattern in FIG. 5.

In this experiment, the structure of Imagio MP C7500 manufactured by RICO Company, Ltd. was employed. The secondary transfer bias (secondary transfer voltage) is applied to the image forming apparatus from a power source outside the apparatus without using a power source disposed therewithin. It should be noted that "Function Generator (FG 300)" manufactured by Yokogawa Electric Corporation is employed as the power source 39 of the secondary transfer bias to form a waveform of a superimposed voltage of the secondary transfer bias, which is then expanded by using "Model 10/40 High-Voltage Power Amplifier" manufactured by Trek, Inc. In addition, "LEATHAC 66" (a trade name, manufactured by TOKUSHU PAPER MFG. CO., LTD.) having a ream weight of 260 kg (a weight of 1000 sheets) and "LEATHAC 66" having a ream weight of 215 kg are used as a recording medium P to have a toner image transferred from the intermediate transfer belt 31. The "LEATHAC 66" has a greater surface roughness than FC Washi type "SAZANAMI" (trade name) manufactured by NBS Ricoh Company, Ltd, does. The "LEATHAC 66" has recessed portions, each having a depth of 100 μm at a maximum.

Next, a description is provided of Examples and Comparative Examples below. FIG. 6 is a table of the relations between image area ratios and the levels of the secondary transfer bias. In FIG. 6, Examples 1 through 4 and Comparative Examples 1 through 3 are shown.

In Comparative Example 1, a power source 39 outputs a secondary transfer bias including only the DC voltage, the level of which is maintained constant even when the image area ratio increases.

In Comparative Example 2, the power source 39 outputs the secondary transfer bias including only the DC voltage, which is gradually increased as the image area ratio increases.

In Comparative Example 3, the power source 39 outputs the secondary transfer bias including the superimposed voltage, in which the AC voltage is superimposed on the DC voltage. The DC voltage is gradually increased as the image area ratio increases. That is, as the image area ratio increases, the target value Vdc1 of Vdc is increased.

In Example 1, the power source 39 outputs the secondary transfer bias including the superimposed voltage under constant voltage control, such that a target voltage V1, which is the target value Vdc1, is gradually reduced as the image area ratio increases. That is, under constant voltage control, as the image area ratio reduces, the target value Vdc1 of Vdc is increased.

In Example 2, the power source 39 outputs the secondary transfer bias including the superimposed voltage under constant voltage control, such that the target voltage V1, which is the target value Vdc1, is gradually reduced in part more than Example 1 does as the image area ratio increases. That is, under constant voltage control, as the image area ratio reduces, the target value Vdc1 of Vdc is increased.

In Example 3, the power source 39 outputs the secondary transfer bias including the superimposed voltage under constant voltage control, such that as the image area ratio increases, a target current A1, which is a target value Vdc1, is gradually reduced, thereby reducing the obtained voltage from the reduced current. That is, under constant voltage control, as the image area ratio reduces, the target value Vdc1 of Vdc is increased.

In Example 4, the power source 39 outputs the secondary transfer bias including the superimposed voltage under constant voltage control, such that the target current A1, which is the target value Vdc1, is gradually reduced in part more than Example 3 does as the image area ratio increases. That is, under constant voltage control, as the image area ratio reduces, the target value Vdc1 of Vdc is increased.

FIG. 7 is a table of evaluation of transferability in a raised portion of a recording medium having an uneven surface according to Comparative Examples 1 through 3 and Examples 1 through 4. FIG. 8 is a table of evaluation of transferability in a recessed portion of a recording medium having an uneven surface according to Comparative Examples 1 through 3 and Examples 1 through 4. In FIG. 7 and FIG. 8, "EXCELLENT" and "GOOD" refer to no occurrence of transfer failure. "FAIR" refers to partial occurrence of transfer failure, and "POOR" refers to occurrence of transfer failure out of a permissible range.

According to the evaluation results of Comparative Examples 1 and 2 in FIG. 7, it is found that with only the DC voltage applied as the secondary transfer bias, increasing the DC voltage as the image area ratio increases improves the transferability in raised portion. In contrast, according to the evaluation results of Comparative Examples 1 and 2 in FIG. 8, it is found that the transferability deteriorates in the recessed portion with only the DC voltage applied as the secondary transfer bias. However, with the superimposed voltage applied as the secondary transfer bias as in Comparative Example 3 and Examples 1 and 2, the transferability improves in the recessed portion compared to Comparative Examples 1 and 2.

In Comparative Example 3 of FIG. 7 that employs the superimposed voltage, the DC voltage is gradually increased as the image area ratio increases. As a result, the transferability deteriorates further in the raised portion as the image area ratio increases, as illustrated in FIG. 7. In contrast, in Examples 1 and 2 of FIG. 7 and FIG. 8 that employ the superimposed voltage, as the image area ratio increases, the DC voltage is gradually reduced. As a result, a favorable transferability is maintained in the recessed portions in Examples 1 and 2 of FIG. 8. In the raised portions, the transferability even improves, as shown in Examples 1 and 2 of FIG. 8. Further, the evaluation results of Examples 1 and 2 of FIG. 7 and FIG. 8 show that with the superimposed voltage applied, reducing the DC voltage as the image area ratio increases provides a favorable transferability in raised portions, irrespective of variation in the image area ratio.

Referring to FIG. 7, in Examples 1, 2, 3, and 4, the DC component included in the superimposed voltage is reduced as the image area ratio increases. As a result, a more favorable transferability is obtained in the raised portion under both of the constant voltage control and the constant current control, than Comparative Example 3, in which the DC component is increased as the image area ratio increases.

That is, while changing Vdc according to a variable image area ratio of a toner image during printing, as the image area ratio increases, Vdc (a direct current (DC) electricity) is reduced, and as the image area ratio reduces, the target value Vdc 1 (a target voltage V1 and a target current A1) of Vdc is increased. In this case, "Vdc" refers to an average value of the secondary transfer bias including the superimposed voltage, in which the AC voltage is superimposed on the DC voltage, during printing.

To increase or reduce the target value Vdc 1 of Vdc, which results in an increase or a reduction in Vdc, either of the DC voltage and the DC current, which are the DC component, may be increased or reduced. To increase or reduce the DC component, the target voltage V1 is gradually increased or reduced under the constant voltage control as in Examples 1 and 2. Alternatively, the target current A1 is gradually increased or reduced under the constant current control as in Examples 3 and 4, to achieve the increase or reduction in the DC component. That is, a read only memory (ROM) 60*b* of the controller 60 preliminarily stores a plurality of target values Vdc1, such as target voltage V1 and target current A1, corresponding to image area ratios. The controller 60 selects a target value Vdc1 from the stored target values Vdc1 in response to the image area ratio obtained by the image area ratio obtaining device 62, to control the power source 39 to output a voltage of the target value Vdc1 selected.

In such a manner, while changing Vdc according to a variable image area ratio, the controller 60 controls the power source 39 to output a bias including a voltage of a target voltage V1 or a current of a target current A1, such that as the image area ratio increases, the value of Vdc is reduced, and such that as the image area ratio reduces, the target value Vdc1 (the target voltage V1 and the target current A1) of Vdc is increased. With this configuration, a favorable transferability is obtained in raised portions with small image area ratios in the recording medium P.

In the present embodiment, the image area ratio is a ratio of an image to a full-one page of a sheet (a recording medium) including the images. Alternatively, the image area ratio may be a ratio of an image to the entire longitudinal area of a secondary transfer nip N (in an axial direction of the nip forming roller 36). In this case as well, while changing Vdc according to a variable image area ratio, the controller 60 controls the power source 39 to output a bias including a voltage of a target voltage V1 or a current of a target current A1, such that as the image area ratio reduces, the target value Vdc1 (the target voltage V1 and the target current A1) of Vdc is increased.

Next, a description is provided of changes in Vdc according to a variable edge ratio of a toner image during printing, such that as the edge ratio increases, the target value Vdc1 of Vdc is increased.

FIG. 9 is a table of the relations between the edge ratios in images and the levels of the DC voltage in the superimposed bias according to Comparative Example 4 and Example 5. In Comparative Example 4, as the edge ratio increases, the DC voltage is reduced. In Example 5, as the edge ratio increases, the DC voltage is increased. That is, in Example 5, as the edge ratio increases, the target value Vdc1 of Vdc is increased while changing Vdc according to a variable edge ratio of the toner image.

FIG. 10 is a table of evaluation of transferability on a raised portion of a recording medium having an uneven surface according to Comparative Example 4 and Comparative Example 5. In FIG. 10, "EXCELLENT" refers to no occurrence of transfer failure. "FAIR" refers to partial occurrence of transfer failure, and "POOR" refers to occurrence of transfer failure out of a permissible range. According to the evaluation results in FIG. 10, with the DC voltage (the target value Vdc1 of Vdc) reduced as the edge ratio increases (Comparative Example 4), the transferability deteriorates as the edge ratio increases. However, as in Example 5, with the DC voltage (the target value Vdc1 of Vdc) increased as the edge ratio increases, a favorable transferability is provided even when the edge ratio increases.

Here, a description is provided of the concept of the edge ratio with reference to patterns illustrated in FIG. 11 A and FIG. 11B. The "edge ratio" refers to a ratio of the length of an edge to an image area ratio.

As illustrated in FIG. 11 A, an image of a square with a side of 2 cm is described as an example.

Image Area: 2 cm×2 cm=4 cm^ 2. Edge Length: 2 cm×4 sides=8 cm. Edge Ratio: 8 cm/4 cm=2 cm. As illustrated in FIG. 11B. an image of 10 lines, each having a length of 2 cm and a width of 0.06 cm, is described as an example.

Image Area: 0.06 cm×2 cm×10 lines=1 cm^2, Edge Length: (0.06 cm×2+2 cm×2)×10 lines=41 cm. Edge Ratio: 41 cm/1 cm=41 cm. As described above, in FIG. 11A and FIG. 11B, the values obtained by dividing the image areas with the edge lengths are represented by dimensionless quantity. However, the expression is not limited to this if the obtained values represent ratios of the edge length in the image areas.

That is, when applying the superimposed bias as the secondary transfer bias according to an edge ratio of a toner image during printing, the controller 60 controls the power source 39 to vary the average value Vdc, such that as the edge ratio increases, the target value Vdc1 of Vdc is increased, thereby outputting a voltage of the increased Vdc1. In this case, "Vdc" refers to an average value of the voltage output during printing. Such a configuration exhibits a favorable transferability on the raised portions of the recording medium P even when the edge ratio increases.

In the present embodiment, as a method for calculating a ratio of en edge portion to a toner image, a photo sensor of the edge detector 63 is used to photograph a toner image, and the photographed image is subjected to an image processing to extract an edge portion. The edge detector 63 calculates the size of the extracted edge portion through either of the methods illustrated in FIG. 11A and FIG. 11B. In the image processing, an image processing logic, which has been preliminarily stored in the controller 60, is used to extract an edge portion and calculate the size of the extracted edge portion. Alternatively, other edge detecting method may be used to obtain the size of the edge portion.

Next, a description is provided of a case that when changing Vdc according to a ratio of a line-and-character image to a solid image in a toner image to be printed, the target value Vdc1 of Vdc is increased as the ratio of the line-and-character increases.

FIG. 12 is a table of the relations between the types of images to be printed, such as a solid image and a line-and-character image, and variable levels of the DC voltage of the secondary transfer bias (the superimposed voltage) according to Comparative Example 5 and Example 6. The types of images include a solid image and a line-and-character image. In Comparative Example 5 of FIG. 12, the level of the DC voltage of the secondary transfer bias (the superimposed bias) is not varied according to the type of an image to be printed, such as the solid image and the line-and-character image. In Example 6, the level of the DC voltage is reduced during printing the solid image, compared to the line-and-character image.

FIG. 13 is a table of evaluation of transferability in a raised portion of a recording medium having an uneven surface according to Comparative Example 5 and Example 6. In Comparative Example 5 of FIG. 13, the level of the DC voltage of the secondary transfer bias (the superimposed bias) is not varied according to the types of an image. As a result, the transferability is poor in the solid image. In Example 6 of FIG. 13, the level of the DC voltage of the secondary transfer bias (the superimposed bias) is reduced during printing the solid image having a large amount of toner, compared to the line-and-character image having a small amount of toner does.

To determine the type of an image from the solid image and the line-and-character image, the controller 60 receives a signal output from either of the first switch 64*a* and the second switch 64*b* constituting the image type selecting device 64. That is, when an operator selects either one of the first switch 64*a* and the second switch 64*b*, the selected image mode (either one of the solid image or the line-and-character image) is set in the controller 60. The controller 60 preliminarily stores the secondary-transfer control logics for the solid image mode and the line-and-character image mode, in respective. In addition, when the superimposed voltage is applied as the secondary transfer bias, the level of the DC voltage of the superimposed bias is preliminarily set according to the image mode having been set in the controller 60. Then, according to the set image mode, the value (the target value) of the DC voltage of the superimposed voltage is changed.

Alternatively, the controller 60 receives output from the potential sensor 38 to detect a toner adhesion amount on the image bearer, such as the photoconductors 2K, 2C, 2M, and 2Y or the intermediate transfer belt 31. Based on the detected toner adhesion amount, the controller 60 further determines either one of the solid image and the line-and-character image. In response to the determination result, the controller 60 changes the value (the target value) of the DC voltage of the superimposed voltage.

That is, when changing Vdc according to the ratio of the line-and-character image to the solid image in a toner image to be printed, the target value Vdc 1 of Vdc is increased as the ratio of the line-and-character image increases. Then, the controller 60 controls the power source 39 to output a voltage of Vdc1, which allows a favorable transferability in the raised portion of the recording medium P even when the ratio of the line-and-character image increases.

Experiment 2

The following experiment was performed as well to analyze conditions to exhibit advantageous effects of the present embodiment.

Figure 14:
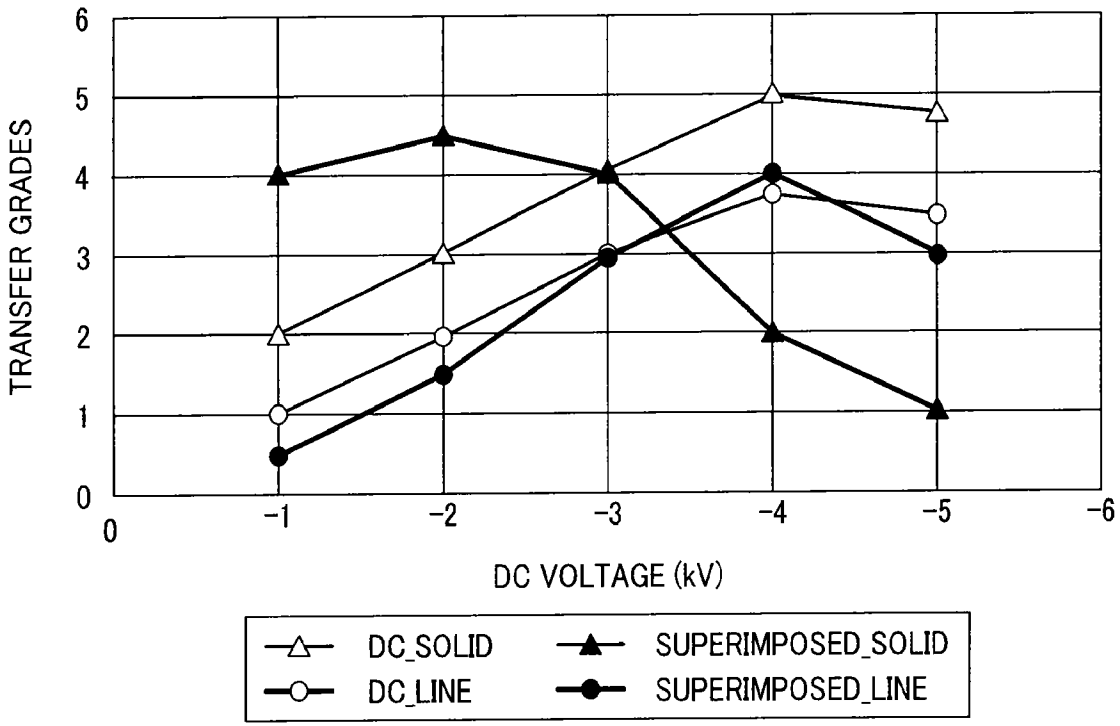
FIG. 14 is a table of the evaluated results of transferability.

In this experiment, "Imagio MPC 7500" manufactured by RICO Company, Ltd. employed in Experiment 1 was used as an image forming apparatus, and "LEATHAC 66" was used as a recording medium P. In Experiment 2, each of a solid image with an image area ratio of 100% and a line image with an image area ratio of 10% is transferred onto a recording medium with only the DC voltage applied. Then, the evaluations of the transferability were graded for the respective images. In addition, each of the solid image and the line image is also transferred onto a recording medium with the superimposed voltage applied, varying the level of the DC voltage included in the superimposed voltage. Then, the evaluations of the transferability were graded for the respective images as well. FIG. 14 is an illustration of evaluation results of Experiment 2. In FIG. 14, the solid image and the line image applied with the DC voltage are indicated as "DC-SOLID" and "DC-LINE", in respective. The solid image and the line image applied with the superimposed voltage are indicated as "SUPERIMPOSED-SOLID" and "SUPERIMPOSED-LINE", in respective.

As illustrated in FIG. 14, when only the DC voltage is applied as the secondary transfer bias, both of the transfer grade for the solid image and the transfer grade for the line image are highest at the same voltage value along the horizontal axis of FIG. 14. In contrast, when the superimposed voltage, in which the AC voltage is superimposed on the DC voltage, is applied with the level of the DC voltage varied, the highest transfer grade of the solid image is obtained with a low level of the DC voltage applied. The highest transfer grade of the line image is obtained with a high level of the DC voltage applied.

This is because, the mechanism that employing the AC voltage improves the transferability of paper having an uneven surface is caused by reciprocal movement of toner, in which toner collides with each other. Since the solid image includes a large amount of toner, the collision of toner sufficiently occurs, which allows the improvement in the transferability even with a low level of the DC voltage applied. However, in the line image, toner having been transferred onto a recording medium is less likely to collide with each other when the toner is caused to return. This fails to improve the transferability on the line image. Thus, a higher level of the transfer voltage is applied for the line image. Therefore, the optimal value of the transfer voltage differs between the solid image and the line image.

As described above, when the superimposed voltage, in which the AC voltage (the AC component) is superimposed on the DC voltage (the DC component), is applied as the secondary transfer bias, the solid image including a large amount of toner obtains a favorable transferability with a lower level of the DC voltage applied than the line image including a small amount of toner does. Thus, when changing Vdc according to the ratio of the line-and-character image to the solid image in the toner image to be printed, the controller 60 controls the power source 39 to output a voltage of an increased Vdc1 of Vdc as the ratio of the line-and-character image increases. The controller 60 also controls the power source 39 to output a voltage of a reduced target value Vdc1 of Vdc as the ratio of the solid image increases.

Next, a description is provided of control of the secondary transfer bias applied to the image forming apparatus of the present embodiment.

Figure 15:
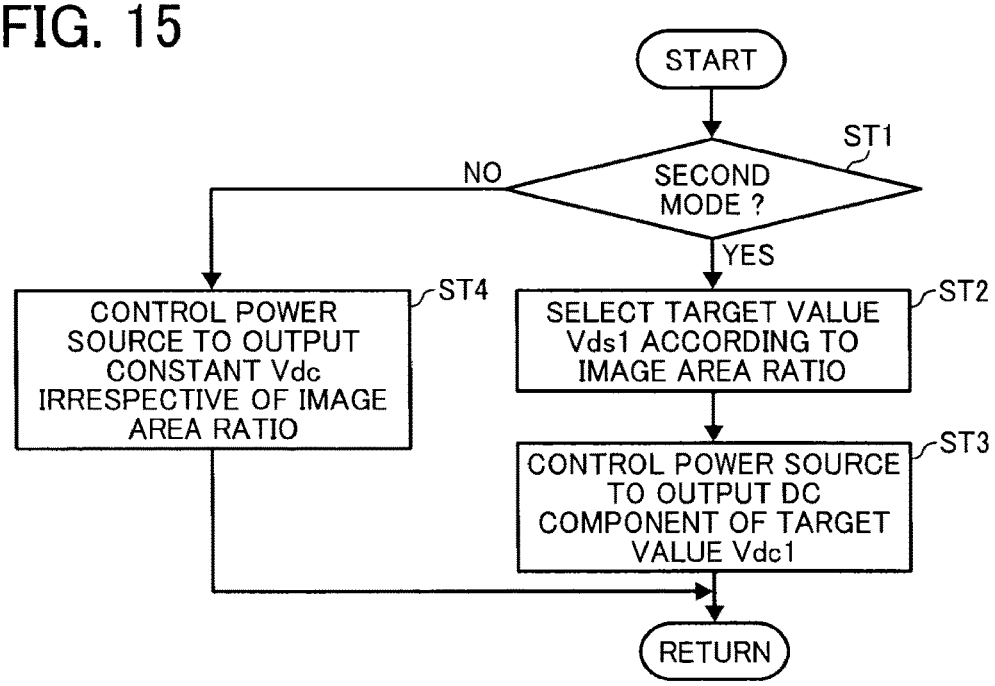
FIG. 15 is a flowchart of one example of control of the transfer bias according to the present disclosure.

To control the secondary transfer bias, a secondary transfer control program, which has been preliminarily stored in the ROM 60*b*, is executed. The secondary transfer bias control program is executed as a subroutine of a print control program preliminarily stored in the ROM 60*b* to control an operation of each part of the image forming apparatus to obtain printed sheets. Alternatively, the secondary transfer bias control program is executed as a preliminary preparation routine of the print control program or as a portion of the print control program. In FIG. 15, the secondary transfer bias control program function as the preliminary preparation routine of the print control program.

As described above, the controller 60 includes the first mode (the DC transfer mode) to output a secondary transfer bias including only the DC voltage to a secondary transfer nip N and the second mode (the AC transfer mode) to output a secondary transfer bias including the superimposed voltage to the secondary-transfer back surface roller 33 to the secondary transfer nip N.

In FIG. 15, the controller 60 determines the transfer bias mode in ST1. When an affirmative determination is made (the transfer bias mode is the second mode), the process goes to ST2. In ST2, the controller 60 selects a target value Vdc1 according to an image area ratio of a toner image during printing, such that as the image area ratio reduces, Vdc is increased. In this case, Vdc refers to an average value of the secondary transfer bias during printing. After the selection of the controller 60 in ST2, the process goes to ST3. In ST3, the controller 60 controls the power source 39 to output a voltage of the target value Vdc1 selected. In particular, the controller 60 controls the DC component adjusting device 61 to adjust the level of the DC component (the DC voltage and the DC current) output from the DC power source 39A.

When a negative determination is made (the transfer bias mode is the first mode) in ST1, the controller 60 controls the power source 39 to maintain Vdc constant irrespective of the image area ratio in ST4.

In this case, a plurality of target values, such as a target voltage V1 and a target current A1, having been increased or reduced according to the image area ratio are preliminarily stored in the ROM 60*b* as a target value Vdc1. In the case of the second mode, the controller 60 selects a target value according to the image area ratio from the stored target values. In response to the selected result, the controller 60 controls the output of the power source 39.

With such a configuration of control of output from the secondary transfer bias, a favorable transferability is obtained in the recessed and raised portions of the recording medium P having an uneven surface in the first mode and the second mode.

Figure 16:
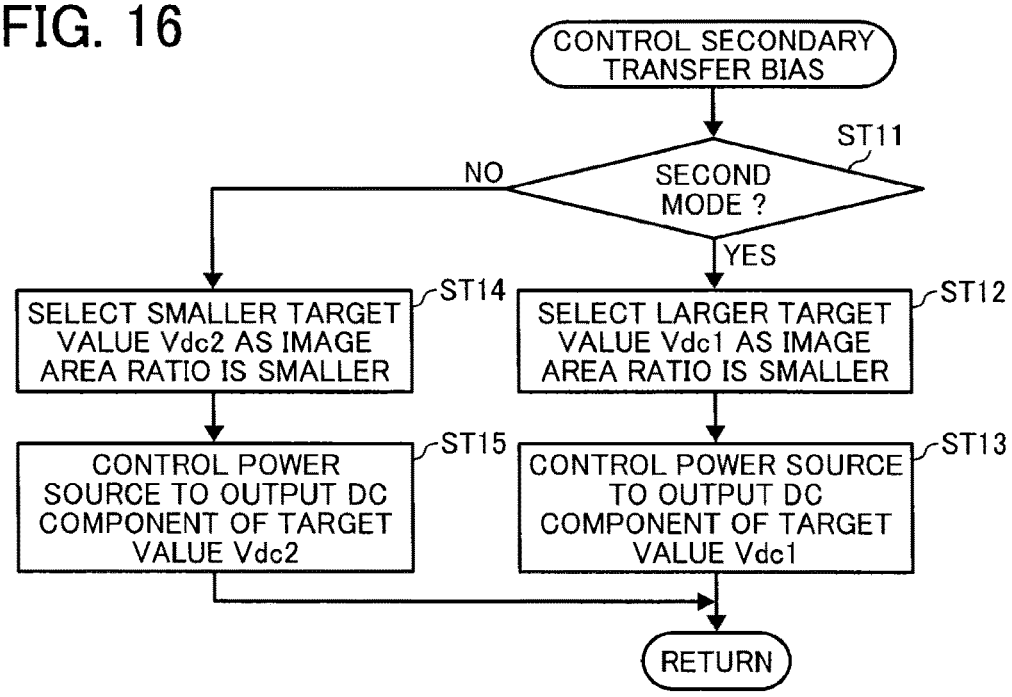
FIG. 16 is a flowchart of another example of control of the transfer bias according to the present disclosure.

FIG. 16 is a flowchart of control of the secondary transfer bias according to another embodiment of the present disclosure. In the same manner as in FIG. 15, a secondary transfer control program, which has been preliminarily stored in the ROM 60*b*, is executed to control the secondary transfer bias. Of course, the secondary transfer bias control program is executed as a subroutine of the above-described print control program, as a preliminary preparation routine of the print control program or as a portion of the print control program. In FIG. 16, the secondary transfer bias control program function as the preliminary preparation routine of the print control program.

As described above, the controller 60 includes the first mode (the DC transfer mode) to output a secondary transfer bias including only the DC voltage to a secondary transfer nip N and the second mode (the AC transfer mode) to output a secondary transfer bias including the superimposed voltage to the secondary-transfer back surface roller 33 to the secondary transfer nip N.

In FIG. 16, the controller 60 determines the transfer bias mode in ST11. When an affirmative determination is made (the transfer bias mode is the second mode), the process goes to ST12. In ST12, the controller 60 selects a target value Vdc1 according to an image area ratio of a toner image during printing, such that as the image area ratio reduces, Vdc is increased. In this case, Vdc refers to an average value of the secondary transfer bias during printing. After the selection of the controller 60 in ST12, the process goes to ST13. In ST13, the controller 60 controls the power source 39 to output a voltage of the target value Vdc1 selected. In particular, the controller 60 controls the DC component adjusting device 61 to adjust the level of the DC component (the DC voltage and the DC current) output from the DC power source 39A.

When a negative determination is made (the transfer bias mode is the first mode) in ST11, the controller 60 selects a target value Vdc according to an image area ratio, such that the target value Vdc2 is reduced as the image area ratio reduces in ST 14. In ST15, the controller 60 controls the power source 39 to output a voltage of the target value Vdc2 selected. In particular, the controller 60 controls the DC component adjusting device 61 to adjust the level of the DC component (the DC voltage and the DC current) output from the DC power source 39A.

In this case as well, a plurality of target values, such as a target voltage V1 and a target current A1, having been increased or reduced according to the image area ratio are preliminarily stored in the ROM60*b* as a target value Vdc1 and a target Vdc2. In the case of the second mode, the controller 60 selects a target value according to the image area ratio from the stored target values. In response to the selected result, the controller 60 controls the output of the power source 39.

With such a configuration of control of output from the secondary transfer bias, a favorable transferability is obtained in the recessed and raised portions of the recording medium P having an uneven surface in the first mode and the second mode.

Embodiment of the image forming apparatus according to the present disclosure is not limited to the image forming apparatus of FIG. 1. The present disclosure can be applied to an image forming apparatus including an intermediate transfer drum of a drum shape, instead of the intermediate transfer belt 31. Further, the present disclosure can be applied to an image forming apparatus including a nip forming belt formed into a belt shape as a transfer device, instead of the nip forming roller 36. Further, the present disclosure can be applied to an image forming apparatus including a transfer roller contacting a photoconductor drum to form a transfer nip, a power source to output voltage to transfer a toner image from the photoconductor drum to a recording medium in the transfer nip, and a controller to control the output of the power source, that is, an image forming apparatus that employs a direct-transfer method.

Next, a description of other embodiments (a second embodiment through a fifth embodiment corresponding to FIG. 9 through FIG. 12, in respective) of the image forming apparatus of the present embodiment is described below.

Figure 17:
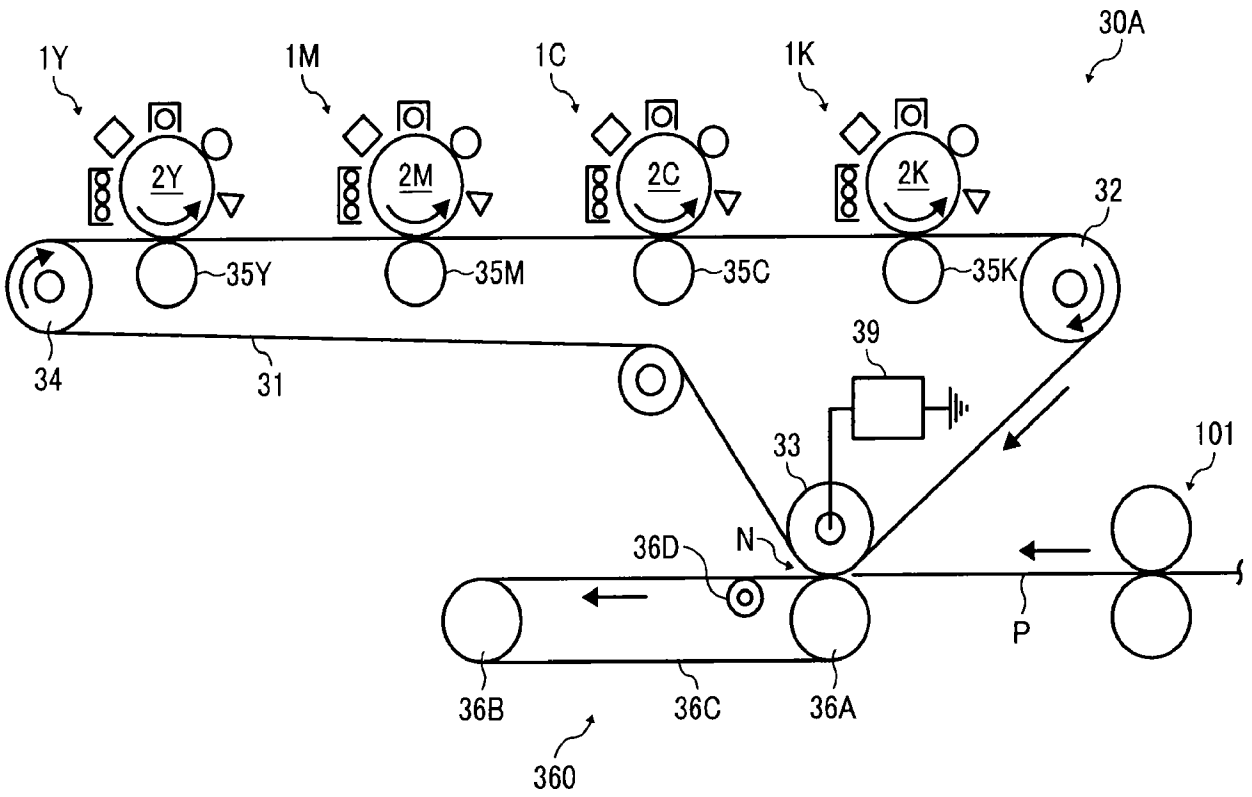
FIG. 17 is an enlarged view of a secondary transfer bias power source and a voltage supplied therefrom in an image forming apparatus according to a second embodiment of the present disclosure.

Now, referring to FIG. 17 (the third embodiment of the image forming apparatus), a transfer unit 30A is mountable on the image forming apparatus, instead of the transfer unit 30 of FIG. 1. The transfer unit 30A includes an intermediate transfer belt 31 as an image bearer formed into a loop, facing image forming units 1Y, 1M, 1C, and 1K, a secondary-transfer back surface roller 33 disposed inside the loop, and a secondary transfer conveyance belt 36C as a transfer device disposed facing the secondary-transfer back surface roller 33. In this embodiment, the intermediate transfer belt 31 (FIG. 17) moves in a direction opposite to the moving direction of the intermediate transfer belt 31 in FIG. 1.

The secondary transfer conveyance belt 36C is wound around a drive roller 36A and a driven roller 36B that constitute a secondary transfer conveyance device 360. The intermediate transfer belt 31 contacting the secondary transfer conveyance belt 36C is positioned between the secondary-transfer back surface roller 33 and the drive roller 36A, which are opposed to each other to form a secondary transfer nip N therebetween. The secondary transfer conveyance belt 36C receives and conveys a recording medium P fed to the secondary transfer nip N by registration rollers 101.

In this embodiment, the drive roller 36A is grounded, and the power source 39 applies a secondary transfer bias to the secondary-transfer back surface roller 33. With the secondary transfer bias supplied from the power source 39 to the secondary-transfer back surface roller 33, a secondary transfer electric field is created at the secondary transfer nip N, where the secondary-transfer back surface roller 33 electrostatically transfers a toner image from the intermediate transfer belt 31 to the secondary transfer conveyance belt 36C. In the secondary transfer nip N, the toner image is secondarily transferred from the intermediate transfer belt 31 onto the recording sheet P having entered the secondary transfer nip N.

The embodiment of application of the secondary transfer bias is no limited to the above configuration that applies the secondary transfer bias to the secondary-transfer back surface roller 33. The secondary transfer conveyance device 360 may include a bias supply roller 36D contacting the secondary transfer conveyance belt 36C from the inside of the loop. The bias supply roller 36D is connected to the power source 39, to receive the secondary transfer bias applied from the power source 39.

Figure 18:
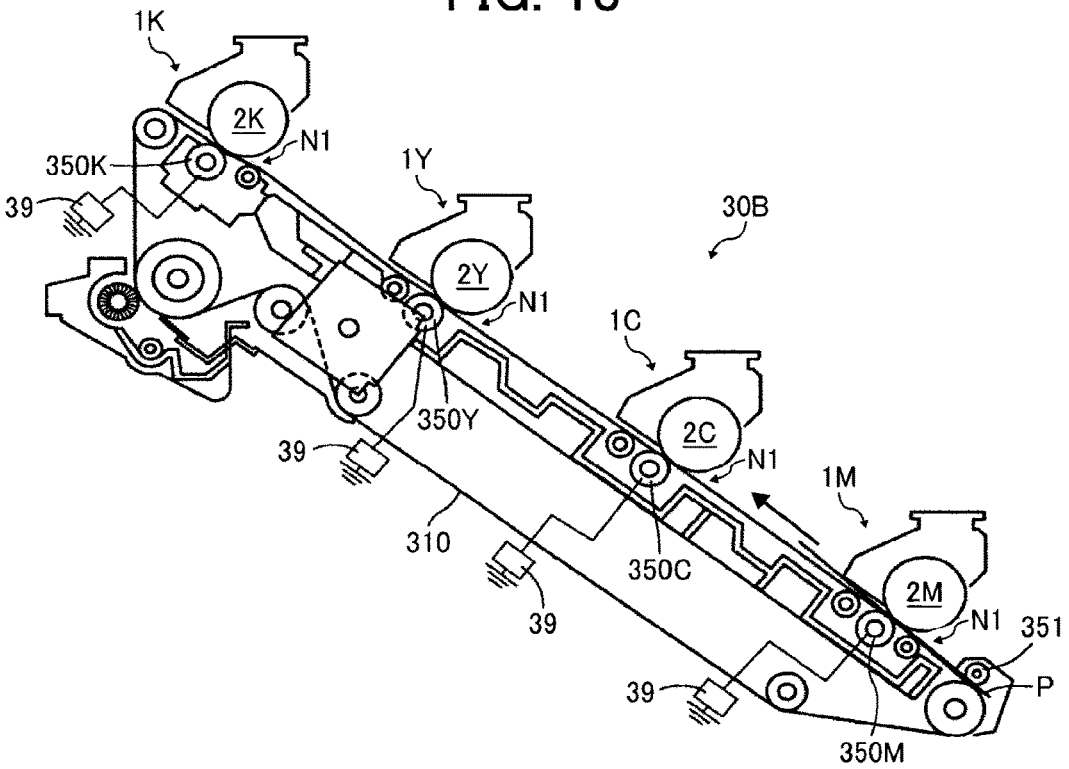
FIG. 18 is an enlarged view of a secondary transfer bias power source and a voltage supplied therefrom in an image forming apparatus according to a third embodiment of the present disclosure.

Now, referring to FIG. 18 (the third embodiment of the image forming apparatus), a transfer unit 30B is mountable on the image forming apparatus, instead of the transfer unit 30 of FIG. 1. The transfer unit 30B includes a transfer conveyance belt 310 as a transfer device, opposed to image forming units 1M, 1C, 1Y, and 1K. The transfer conveyance belt 310 is looped around a plurality of rollers. The transfer conveyance belt 310 rotates in the counterclockwise direction to attract a recording medium P fed by a registration roller to convey the recording medium P toward a transfer nip N1. The transfer conveyance belt 310 further includes transfer rollers 350M, 350C, 350Y, and 350K disposed inside the looped transfer conveyance belt 310, respectively opposed to photoconductors 2M, 2C, 2Y, and 2K. The transfer rollers 350M, 350C, 350Y, and 350K press the transfer conveyance belt 310 against the photoconductors 2M, 2C, 2Y, and 2K. Accordingly, the photoconductors 2M, 2C, 2Y, and 2K contact the transfer conveyance belt 310 to form a transfer nip N1 for each color.

In the present embodiment, the photoconductors 2M, 2C, 2Y, and 2K are grounded. The transfer rollers 350M, 350C, 350Y, and 350K receive transfer bias from the respective power sources 39. Thus, at each of the transfer nips N1 for yellow, magenta, cyan, and black is formed a transfer electric field that electrostatically moves a toner image from each of the photoconductors 2M, 2C, 2Y, and 2K to the transfer roller side.

The recording medium P moves forward from the lower right of the drawing sheet to pass between a sheet attraction roller 351 applied with a bias and the transfer conveyance belt 310, which electrostatically attracts the recording medium P. The recording medium P attracted by the transfer conveyance belt 310 moves to the transfer nip N1 for each color. In each of the transfer nip N1, a composite toner image or a single-color toner image is transferred onto the recording medium P having entered the transfer nip N1 by the secondary transfer electric field and the nip pressure applied thereto, thereby forming a full-color image or a single-color toner image on the surface of the recording medium P.

In the present embodiment, the separate power sources 39 apply the transfer bias to the respective transfer rollers 350M, 350C, 350Y, and 350K. Alternatively, in some embodiments, one power source 39 may applies a transfer bias to the transfer rollers 350M, 350C, 350Y, and 350K.

Figure 19:
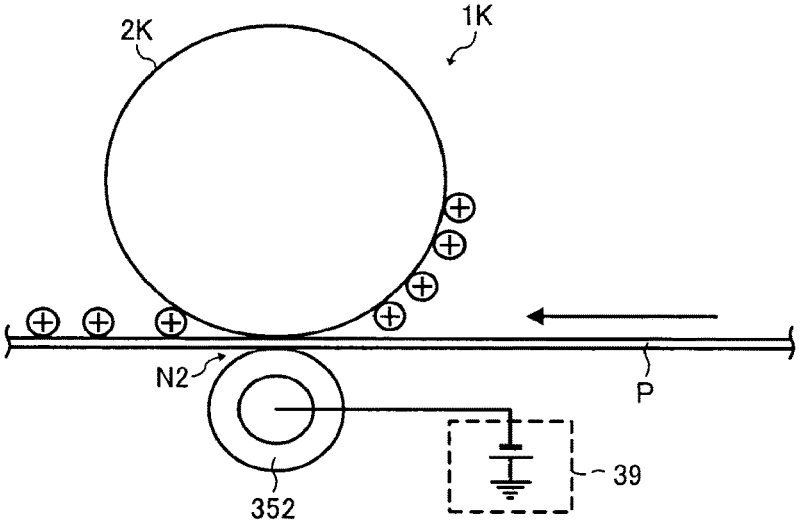
FIG. 19 is an enlarged view of a secondary transfer bias power source and a voltage supplied therefrom in an image forming apparatus according to a fourth embodiment of the present disclosure.

In the embodiments described above, the description has been provided of the image forming apparatus that forms full-color images. However, the present disclosure is not limited to the image forming apparatus that forms full-color images. For example, FIG. 19 (the fourth embodiment) illustrates a monochrome image forming apparatus, in which an image forming unit 1K for black includes a photoconductor 2K for black, opposed to a transfer roller 352 as a transfer device. The present disclosure may be applied to such a monochrome image forming apparatus according to the fourth embodiment.

The transfer roller 352 is constituted of a cored bar made of, for example, stainless steel and aluminum, having a resistance layer of a conductive sponge on the core metal. The resistance layer may have a surface layer made of fluororesin.

The transfer roller 352 contacts the photoconductor 2K to form a transfer nip N between the transfer roller 352 and the photoconductor 2K. The photoconductor 2K is grounded. The transfer roller 352 receives transfer bias from a power source 39. Thus, between the transfer roller 352 and the photoconductor 2K is formed a transfer electric field that electrostatically moves a toner image from the photoconductor 2K to the transfer roller 352 side. That is, the toner image is transferred from the photoconductor 2 onto the recording sheet P having entered the transfer nip N2 by the transfer field and the nip pressure.

Figure 20:
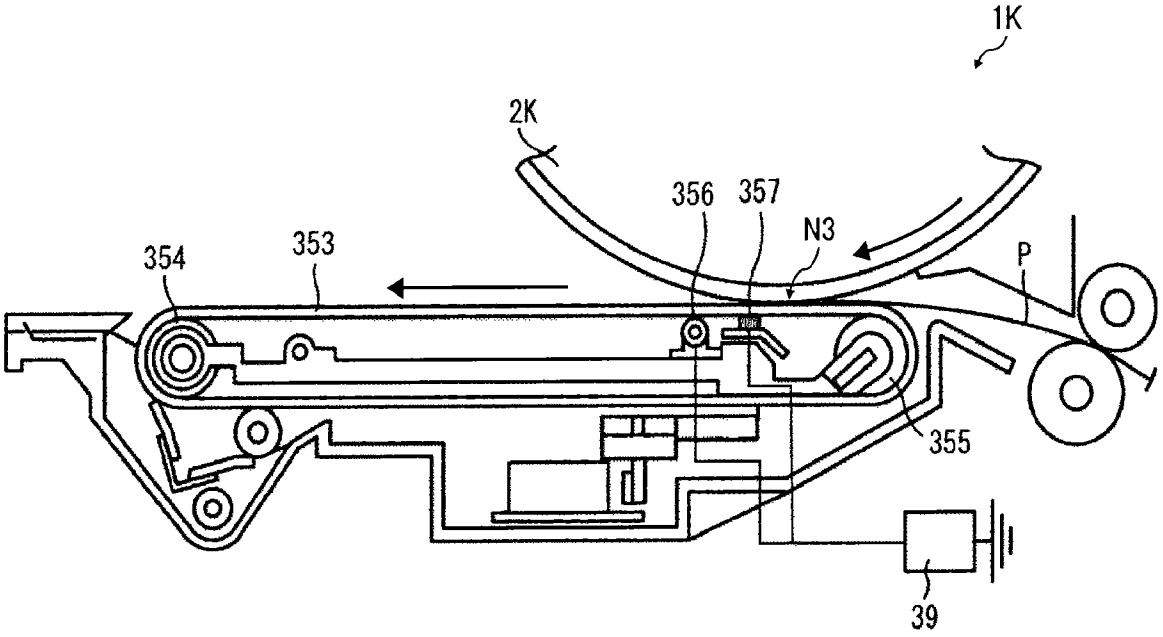
FIG. 20 is an enlarged view of a secondary transfer bias power source and a voltage supplied therefrom in an image forming apparatus according to a fifth embodiment of the present disclosure.

Next, referring to FIG. 20 (the fifth embodiment), an image forming apparatus according to the fifth embodiment includes a transfer conveyance belt 353 as a transfer device, contacting one photoconductor 2K opposed to the transfer conveyance belt. The transfer conveyance belt 353 is wound around and stretched taut around a drive roller 354 and a driven roller 355, the transfer conveyance belt 353 rotating in a direction illustrated in FIG. 12. The transfer conveyance belt 353 partially contacts the photoconductor 2K between the drive roller 354 and the driven roller 355, to form a transfer nip N3. The transfer conveyance belt 353 receives and conveys a recording medium P fed to the transfer nip N3.

Inside the loop of the transfer conveyance belt 353 are disposed a transfer bias roller 356 and a bias brush 357. The transfer bias roller 356 and the bias brush 357 contacts the inner surface of the transfer conveyance belt 353 at downstream of the transfer nip N3 in a direction of movement of belt.

In the present embodiment, the photoconductor 2K is grounded. The transfer bias roller 356 and the bias brush 357 receives transfer bias applied from the power source 39. Accordingly, at the transfer nip N3 is formed a transfer electric field that electrostatically moves a toner image from the photoconductors 2K to the transfer conveyance belt 353 side. In the transfer nip N3, the toner image is transferred, by the transfer electric field and the nip pressure, from the photoconductor 2K onto the recording sheet P, which has been conveyed by the transfer conveyance belt 353 and has entered the secondary transfer nip N3.

In the image forming apparatus of the present embodiment, both of the transfer bias roller 356 and the bias brush 357 are disposed contacting the transfer conveyance belt 353. The present disclosure is not limited to the present embodiment. The image forming apparatus does not necessarily include the combination of the transfer bias roller 356 and the bias brush 357, and either one of the transfer bias roller 356 and the bias brush 357 may be included in some embodiments. Alternatively, in some embodiments, the transfer bias roller 356 and the bias brush 357 may be disposed below the transfer nip N3.

In the second embodiment of FIG. 20 through the fifth embodiment of FIG. 12, a controller 60 controls the power source 39 to output an alternated secondary transfer bias (transfer bias) including a superimposed voltage, such that Vcd is reduced as the image area ratio increases, and such that the target value Vdc1 of Vdc is increased as the image area ratio reduces, to change Vdc during printing according to a variable image area ratio of a toner image to be printed. In this case, Vdc refers to an average value of the secondary transfer bias during printing. Further, the controller 60 controls the power source 39 as a transfer bias power source to output a transfer bias, such that the level of the DC component is reduced when the target Vdc 1 of Vdc is small, and that the level of the DC component is reduced when the target value Vdc1 of Vdc is great. With such a configuration, transfer failure is reduced, thereby obtaining a favorable transferability in the raised portions of the recording medium P having an uneven surface.

Although the embodiments of the present disclosure have been described above, the present disclosure is not limited to the embodiments described above, but a variety of modifications can naturally be made within the scope of the present disclosure.

The image forming apparatus of the present disclosure is not limited to a printer. The image forming apparatus includes, but is not limited to, a copier, a printer, a facsimile machine, and a multi-functional system including a combination thereof.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image bearer having a surface to bear a toner image to be printed;

a transfer device that contacts the surface of the image bearer to form a transfer nip; and a transfer bias power source that outputs a transfer bias to transfer the toner image from the image bearer onto a recording medium interposed between the transfer device and the image bearer in the transfer nip, wherein the transfer bias power source outputs an alternately switching voltage that alternates between a transfer-directional voltage having a polarity to transfer the toner image from the image bearer onto the recording medium and a return-directional voltage having an opposite polarity to the polarity of the transfer-directional voltage, and the transfer bias power source reduces a target value of Vdc as an image area ratio of the toner image increases, the transfer bias power source increases the target value of Vdc as the image area ratio reduces, and the transfer bias power source increases the target value of Vdc as an edge ratio of the toner image increases, where Vdc is an average value of the alternately switching voltage during printing.

2. The image forming apparatus according to claim 1, wherein the transfer bias power source increases the target value of Vdc as an image area ratio of the toner image to an entire longitudinal area of the transfer nip reduces.

3. The image forming apparatus according to claim 1, wherein the transfer bias power source increases the target value of Vdc as a ratio of a line-and-character image to a solid image of the toner image increases.

4. The image forming apparatus according to claim 1, wherein a time period of application of the transfer-directional voltage is longer than a time period of application of the return-directional voltage.

5. The image forming apparatus according to claim 1, wherein the transfer bias power source switches between a first mode to output only a direct current voltage and a second mode to output the alternately switching voltage, maintains the target value of Vdc constant irrespective of the image area ratio in the first mode, and increases the target value of Vdc as the image area ratio reduces in the second mode.

6. The image forming apparatus according to claim 1, wherein the transfer bias power source outputs a superimposed voltage in which an alternating component is superimposed on a direct component, the direct component to be under constant current control.

7. The image forming apparatus according to claim 1, further comprising:

control circuitry that controls a superimposed voltage, in which an alternating component is superimposed on a direct component, that is output from the transfer bias power source, wherein the control circuitry controls the transfer bias power source to reduce an amount of the direct current component as the target value of Vdc decreases, and to increase the amount of the direct current component as the target value of Vdc increases.

8. The image forming apparatus according to claim 1, wherein the toner image is a color image.

9. The image forming apparatus according to claim 7, wherein the control circuitry receives a detection signal from a sensor that detects a toner adhesion amount on the image bearer, and the control circuitry adjusts the direct current component of the superimposed voltage according to the toner adhesion amount.

10. An image forming apparatus, comprising:

an image bearer having a surface to bear a toner image to be printed;

a transfer device that contacts the surface of the image bearer to form a transfer nip; and a transfer bias power source that outputs a transfer bias to transfer the toner image from the image bearer onto a recording medium interposed between the transfer device and the image bearer in the transfer nip, wherein the transfer bias power source outputs an alternately switching voltage that alternates between a transfer-directional voltage having a polarity to transfer the toner image from the image bearer onto the recording medium and a return-directional voltage having an opposite polarity to the polarity of the transfer-directional voltage, the transfer bias power source switches between a first mode to output only a direct current voltage and a second mode to output the alternately switching voltage, the transfer bias power source reduces a target value of Vdc as an image area ratio of the toner image increases, the transfer bias power source increases the target value of Vdc as the image area ratio reduces, the transfer bias power source reduces the target value of Vdc as the image area ratio reduces in the first mode, and the transfer bias power source increases the target value of Vdc as the image area ratio reduces in the second mode, where Vdc is an average value of the alternately switching voltage during printing.

11. The image forming apparatus according to claim 10, further comprising:

control circuitry that controls a superimposed voltage, in which an alternating component is superimposed on a direct component, that is output from the transfer bias power source, wherein the control circuitry controls the transfer bias power source to reduce an amount of the direct current component as the target value of Vdc decreases, and to increase the amount of the direct current component as the target value of Vdc increases.

12. The image forming apparatus according to claim 11, wherein the control circuitry receives a detection signal from a sensor that detects a toner adhesion amount on the image bearer, and the control circuitry adjusts the direct current component of the superimposed voltage according to the toner adhesion amount.

13. An image forming apparatus, comprising:

a transfer device that contacts a surface of an image bearer to form a transfer nip, the surface carrying a toner image to be printed; and a transfer bias power source configured to output a transfer bias to transfer the toner image from the image bearer onto a recording medium interposed between the transfer device and the image bearer in the transfer nip;

output an alternately switching voltage that alternates between a transfer-directional voltage having a polarity to transfer the toner image from the image bearer onto the recording medium and a return-directional voltage having an opposite polarity to the polarity of the transfer-directional voltage;

reduce a target value of Vdc as an image area ratio of the toner image increases, Vdc being an average value of the alternately switching voltage during printing of the tone image;

increase the target value of Vdc as the image area ratio reduces; and increase the target value of Vdc as an edge ratio of the toner image increases.

14. The image forming apparatus according to claim 13, wherein the transfer bias power source increases the target value of Vdc as an image area ratio of the toner image to an entire longitudinal area of the transfer nip reduces.

15. The image forming apparatus according to claim 13, wherein the transfer bias power source increases the target value of Vdc as a ratio of a line-and-character image to a solid image of the toner image increases.

16. The image forming apparatus according to claim 13, wherein a time period of application of the transfer-directional voltage is longer than a time period of application of the return-directional voltage.

17. The image forming apparatus according to claim 13, wherein the transfer bias power source switches between a first mode to output only a direct current voltage and a second mode to output the alternately switching voltage, maintains the target value of Vdc constant irrespective of the image area ratio in the first mode, and increases the target value of Vdc as the image area ratio reduces in the second mode.

18. The image forming apparatus according to claim 13, wherein the transfer bias power source outputs a superimposed voltage in which an alternating component is superimposed on a direct component, the direct component to be under constant current control.

19. The image forming apparatus according to claim 13, further comprising:

control circuitry that controls a superimposed voltage, in which an alternating component is superimposed on a direct component, that is output from the transfer bias power source, wherein the control circuitry controls the transfer bias power source to reduce an amount of the direct current component as the target value of Vdc decreases, and to increase the amount of the direct current component as the target value of Vdc increases.

20. The image forming apparatus according to claim 13, wherein the toner image is a color image.

* * * * *